US006253993B1

(12) United States Patent
Lloyd et al.

(10) Patent No.: US 6,253,993 B1
(45) Date of Patent: Jul. 3, 2001

(54) SELF-ERECTING CONTAINER APPARATUS

(75) Inventors: Michael M. Lloyd, Rogers, AR (US); Jeffrey S. James, Elmhurst, IL (US); Kerry Donavon Wellner, Frisco, TX (US); Karen M. Chiera, Elmhurst; Kenneth J. Zion, Villa Park, both of IL (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/306,282

(22) Filed: May 6, 1999

Related U.S. Application Data

(63) Continuation-in-part of application No. 09/090,015, filed on Jun. 3, 1998, now Pat. No. 6,155,479.

(51) Int. Cl.[7] ..... B65D 5/24; B65D 5/74

(52) U.S. Cl. ..... 229/117.3; 229/112; 229/117.15; 229/117.35; 229/186

(58) Field of Search ..... 229/112, 117.13, 229/117.14, 117.15, 117.3, 117.32, 117.35, 125.14, 125.15, 186

(56) References Cited

U.S. PATENT DOCUMENTS

| | | |
|---|---|---|
| 181,014 | 8/1876 | Scott . |
| 615,417 | 12/1898 | Wilcox . |

(List continued on next page.)

FOREIGN PATENT DOCUMENTS

| | | |
|---|---|---|
| 29 08 654 | 3/1979 | (DE) . |
| 28 09 946 | 9/1979 | (DE) . |
| 3610615 | 10/1987 | (DE) . |
| 0 273 102 | 7/1987 | (EP) . |
| 2 188 301 | 10/1978 | (GB) . |
| 1 529 062 | 10/1979 | (GB) . |
| 2 172 663 | 9/1986 | (GB) . |
| 2 246 764 | 12/1992 | (GB) . |

OTHER PUBLICATIONS

Fibre Box Association, "Marketing in Action Box–A–Rama 1974: Entries in the 1974 Box Competition".

Box Expo 78, "Creative Corrugated Packaging", pp. 86, 97 and 94.

1970 Box Competition, "Showcase 70's ", pp. 28, 82, 30 and 100.

*Primary Examiner*—Gary E. Elkins
(74) *Attorney, Agent, or Firm*—Dick & Harris

(57) ABSTRACT

The present invention is directed to a self-erecting container formed from the rapid deployment of flattened, partially articulated and/or pre-glued blanks into an articulated orientation, for the facilitated containment and dispensing of fluid articles. The self-erecting container comprises a bottom panel, two end panels, two side panels, and a pair of corner panels joining each end panel to each side panel. One of each pair of corner panels is affixed to one of opposed side or end panels, forming a container pocket having a substantially collapsed orientation. Upon raising of the end or side panels, respectively, the corner panels cause the respective side or end panels to be automatically be raised relative to the bottom panel, and the container pocket prompted to a substantially upright and expanded orientation. The container further comprises a fluid article holding bag attached to a nozzle, which is inserted into at least one aperture in one of the bottom, end and side panels. The bag may be positioned in the container pocket in either the collapsed or expanded orientations. The container may further include one or more top panels and handle panels, with one or more handle securing elements for stabilizing the handle panels and/or strengthening the container. The container may also include a nozzle guard for securing the nozzle in the aperture, and preventing collapse of the nozzle into the container during filling with fluid articles.

25 Claims, 16 Drawing Sheets

U.S. PATENT DOCUMENTS 886,074 4/1908 Reber .
916,509 3/1909 Wade .
921,197 5/1909 Zell .
922,345 5/1909 Shaffer .
956,236 4/1910 Wagnitz .
959,261 5/1910 Reber .
991,052 5/1911 Draper .
996,746 7/1911 Bloomer .
1,003,150 9/1911 Potter .
1,003,510 9/1911 Reber .
1,040,984 10/1912 Reber .
1,046,017 12/1912 Reber .
1,046,945 12/1912 Bauer et al. .
1,068,802 7/1913 Merrell et al. .
1,088,964 3/1914 Buchman .
1,135,588 4/1915 Kendrick .
1,226,024 * 5/1917 Stohs et al. ..... 229/125.15
1,694,126 12/1928 Joslin .
1,700,758 2/1929 Berkowitz .
1,758,510 5/1930 Gross .
1,926,366 9/1933 Berstein .
1,957,264 5/1934 Gross .
2,036,460 4/1936 Conescu .
2,185,353 1/1940 Platt et al. .
2,227,383 12/1940 Synder .
2,255,223 9/1941 Lighter .
2,293,342 8/1942 Inman .
2,384,480 9/1945 Lupton .
2,574,931 11/1951 Nason, Jr. ..... 222/95
2,618,409 11/1952 Eisenberger et al. ..... 222/103
2,932,439 4/1960 Sparling .
2,954,901 10/1960 Winstead .
3,054,549 9/1962 Humphrey .
3,058,645 10/1962 Luterick .
3,078,018 2/1963 Galloway .
3,081,911 3/1963 Scholle .
3,087,655 4/1963 Scholle .
3,090,526 5/1963 Hamilton et al. .
3,108,732 10/1963 Curie et al. .
3,117,695 1/1964 Cox, Jr. .
3,119,544 1/1964 Cope et al. .
3,123,254 3/1964 Rabby et al. .
3,132,789 5/1964 Forrest .
3,143,249 8/1964 Merrill et al. ..... 222/105
3,160,326 12/1964 Sturdevant et al. .
3,163,544 12/1964 Valyi .
3,169,690 2/1965 Scholle .
3,173,579 3/1965 Curie et al. .
3,206,094 * 9/1965 Humphrey et al. ..... 229/117.3
3,226,002 12/1965 Walker .
3,227,322 1/1966 Crain ..... 222/183
3,233,817 2/1966 Casady .
3,349,986 10/1967 Chapman et al. .
3,363,807 1/1968 Powell ..... 222/105
3,427,646 2/1969 Scholle .
3,905,544 9/1975 Tipton .
3,927,824 12/1975 Razziano .
3,931,916 1/1976 Blue et al. ..... 222/465
3,952,940 4/1976 Malcolm .
4,148,429 4/1979 Burr et al. .
4,174,051 11/1979 Edwards et al. .
4,361,236 11/1982 Lavery .
4,375,864 3/1983 Savage ..... 222/81
4,447,004 5/1984 House et al. .
4,465,227 8/1984 Hood et al. .
4,572,422 2/1986 Heuberger et al. .
4,607,786 8/1986 Weaver .
4,653,671 3/1987 Duffy et al. ..... 222/105
4,781,314 11/1988 Schoonover et al. ..... 222/465.1
4,791,883 12/1988 Lehman et al. .
4,815,631 3/1989 Eeg et al. .
4,830,271 5/1989 Lau et al. ..... 229/117
4,850,509 7/1989 Hollenberg .
4,869,424 9/1989 Wood ..... 229/113
4,895,250 1/1990 Schifrin ..... 206/223
4,934,654 6/1990 Linnemann .
4,949,900 8/1990 Ballu ..... 229/125.26
5,037,002 8/1991 Tschanen .
5,042,682 8/1991 Ritter et al. .
5,048,691 9/1991 Heuberger et al. .
5,062,527 11/1991 Westerman ..... 229/117
5,094,359 * 3/1992 DeMars et al. ..... 229/186
5,125,566 6/1992 Deiger ..... 229/125.15
5,147,062 9/1992 Heuberger et al. .
5,147,071 9/1992 Rutter et al. .
5,156,295 10/1992 Gordon et al. .
5,163,485 11/1992 Hermann ..... 141/10
5,169,019 12/1992 Budenbender .
5,176,313 1/1993 Curry et al. .
5,201,462 4/1993 Sada et al. .
5,284,294 2/1994 Floyd ..... 229/179
5,392,958 2/1995 Kurtzahn et al. ..... 222/105
5,482,179 * 1/1996 Bruhn ..... 229/117.3
5,638,978 6/1997 Cadiente .
5,715,992 2/1998 Andrews, Sr. et al. ..... 229/125.15
5,799,818 * 9/1998 Ringer ..... 229/117.3

* cited by examiner

SELF-ERECTING CONTAINER APPARATUS

The present application is a continuation-in-part application of Ser. No. 09/090,015, filed Jun. 3, 1998, U.S. Pat. No. 6,155,479.

BACKGROUND OF THE INVENTION

1. The Technical Field

The present invention relates in general to containers fabricated from cardboard, paperboard and corrugated paperboard and the like, and, more particularly, to self-erecting containers for containment and dispensing of fluid articles from bags contained therein.

2. The Prior Art

Containers fabricated from cardboard, paperboard, corrugated paperboard and the like have been used in combination with liquid holding bags for several years. In particular, these bag-in-box containers have proved to be durable, convenient, and cost-effective for use in storing, transporting, and dispensing various liquids and beverages, such as wine, soft drinks, and coffee. Many of these containers have a concealed inner region for housing a liquid holding bag, a pouring spout, and a handle for carrying.

For example, Andrews, Sr. et al., U.S. Pat. No. 5,715,992, discloses a paperboard beverage container particularly suited for carrying and dispensing multiple cups of coffee. In particular, the '992 beverage container consists of an outer shell with two pairs of opposing sidewalls, an opening in one of the sidewalls, a bag within the outer shell, and a mouth attached to the bag. The mouth is positioned in the opening to allow fluid to be transferred from the bag to a receptacle, such as a cup or mug. The beverage container further consists of a series of upper end flaps forming a top and a handle, and a series of lower end flaps forming a bottom. The bottom is preferably recessed to avoid contact of hot coffee contained in the bag with a supporting surface, such as furniture.

However, in certain industries and businesses which employ containers fabricated from cardboard, paperboard, corrugated paperboard and the like, such as the fast food industry, the catering industry, the retail coffee industry, etc., it is often important that the containers be configured for articulation into their "use" configurations in an efficient, reliable and rapid manner.

Certain rapid deployment containers are also known in the art. For example, Westerman, U.S. Pat. No. 5,062,527, discloses a "slotless" container which is lidless, and is formed from a single blank having no perforations, holes, apertures or cuts of any kind. The blank is divided by fold lines into a rectangular bottom panel, and rectangular side and end panels which contiguously emanate from the edges of the rectangular bottom panel. Square corner panels are positioned between and emanate from the edges of adjacent side and end panels. A central fold line bisects the blank from one end panel edge to the opposite end panel edge, and diagonal fold lines diagonally bisect the corner panels and extend into the bottom panel.

By bending the corner panels about the diagonal fold lines, so that the edges formed by the diagonal fold lines project toward the interior of the container, while simultaneously folding the side and end panels upward to positions perpendicular to the bottom panel, an open-topped rectangular parallelepiped container is formed. The panels in the apparatus of the Westerman '527 patent are sized so that the diagonal fold lines of the corner panels, upon completed articulation of the blank, extend all the way up to the "top" edges of the side and end panels. Thus, no paths for leakage of liquids is provided in the completely articulated container. However, as can be seen from the illustrations of the Westerman '527 patent, the folded corner panels overlap one another when the container is in its fully erected configuration.

The Westerman '527 patent also discloses lining or coating the interior of the container with a liquid-proof material, in order to permit the erected container to be used to contain materials such as medical waste, without danger of leakage. A simple flat lid, fabricated from a separate structure or blank, is used to cover the container.

Another class of containers which address the foregoing issues is known generally as the class of "self-erecting" containers. An example of a self-erecting container is The Ice Cube™ corrugated ice chest/cooler container manufactured by Wesland Container of Little Rock, Ark. The configuration of the blank for the Wesland Container article is similar to that of the Westerman '527 apparatus, except that lid panels emanate from the upper edges of the side panels, and locking panels emanate from the upper edges of the end panels. Handle panels emanate from the upper, inner edges of the lid panels. In addition, the corner panels are not rectangular, but instead are formed from two trapezoidal members (left by removing squares), bisected by the diagonal fold lines, from the free corners of each of the corner panels.

By making the corner panels in the foregoing manner, and by appropriate proportioning of the dimensions of the various panels permits the folded corner panels to be folded against the inner surface of the side panels, and glued thereto, without the folded corner panels overlapping one another. An additional effect of the formation of the corner panels is that the diagonal fold lines do not reach to the top edges of the container, thus creating potential leakage flow paths.

By gluing one of each of the pairs of folded juxtaposed corner panels to the opposed inside surfaces of the side panels, upon folding the end panels and corner panels over the bottom and side panels, a self-erecting feature is created. After the glue has set, upon pulling up of the flattened end panels, the corner panels cause the side panels to be moved in concert with the end panels, to form the container enclosure.

The Wesland Container apparatus is also provided with the knock-down feature of the long fold line bisecting the entire blank, and the diagonal folds in the bottom panel, which permit the side panels to be pressed against one another, while the end panels are folded inwardly upon themselves to create a flattened, collapsed container.

The Wesland Container apparatus is likewise provided with a slotless, imperforate blank, and a liquid-proof coating on the inside surface of the blank, so that ice, etc., may be safely carried in the container, without leakage.

Closure of the Wesland Container is provided by folding the top panels over the container space. The handle panels are then folded upward to be perpendicular to the bottom of the container. The handle panels are also provided with hooks, which are engaged by slots on the lock panels.

Although these and other slotless and self-erecting containers have improved the efficiency and reliability of rapid deployment containers, it would be desirable to provide an improved self-erecting container apparatus which is adapted for use in bag-in-a-box applications. Moreover, it would also be desirable to provide an improved self-erecting container which is structured for fast, rapid, and reliable deployment from an easily shippable configuration to an articulated "use" configuration.

These and other objects of the present invention will become apparent, in light of the present description, claims and drawings.

SUMMARY OF THE INVENTION

The present invention is directed to a self-erecting container apparatus formed from the rapid deployment of a flattened, partially articulated and/or pre-glued blank into an articulated orientation, for the facilitated containment and dispensing of fluid articles. The self-erecting container apparatus comprises a blank, a nozzle and a fluid article holding bag. In a preferred embodiment, the blank comprises a bottom panel, two end panels, two side panels, a plurality of paired of corner, two top panels, two handle panels and two handle support panels.

The end panels foldably emanate from the end edges of the bottom panel, while the side panels foldably emanate from the side edges of the bottom panel. In a preferred embodiment, the side panels are substantially trapezoidal in shape to, in turn, make the container apparatus substantially trapezoidal in shape with an angled or ramped top. The end panels preferably differ in size to accommodate this angled or ramp-top trapezoidal structure.

At least one of the bottom panel, end panels and side panels includes an aperture capable of accepting a nozzle. In a preferred embodiment, one of the end panels includes an aperture, which is preferably surrounded by a weakened region. The weakened region allows a portion of the end panel to be temporarily deformed upon insertion of the nozzle, but then regain its original structure to retain the nozzle within the aperture. In another preferred embodiment, the container includes two apertures to facilitate both filling and dispensing of fluid articles.

The paired corner panels join each end panel to each side panel. The paired corner panels, in turn, are joined by lines of weakness, which may be perforated or scored to facilitate articulation of the container blank.

The top panels foldably emanate from the top edge regions of the side panels. The handle panels, in turn, foldably emanate from the top edge regions of the top panels. The handle panels comprise opposing side edge regions, a top edge region, and a handle opening with an inner edge region. In a preferred embodiment, the handle panels include a handle panel securing element, such as a locking tab attached to the inner edge region of one or more handle panels, to secure the handle panels in a substantially juxtaposed orientation.

In another preferred embodiment, the handle panel securing element comprises an inverted handle stabilizing panel emanating from the top edge region of one of the handle panels. The inverted handle stabilizing panel preferably works in conjunction with the handle panel from which it emanates, to sandwich and secure the handle panel attached to the opposing top panel. The inverted handle stabilizing panel may also include a locking tab.

In yet another preferred embodiment, the handle panel securing element comprises projecting locking members associated with the side regions of the handle panels. The projecting locking members cooperate with the handle support panels, which foldably emanate from the end panels. The handle support panels preferably include slots for releasably accepting the projecting locking members.

The bag has at least one opening, through which it is attached to the nozzle. The bag is constructed to hold various fluid articles, including liquids, drink mixes, and other fluids—both hot and cold. In a preferred embodiment, the nozzle comprises a first end, a second end and a detent positioned therebetween. While the nozzle is preferably sealed to the bag at its first end, the detent preferably comprises a series of concentric rings, spaced apart so as to sandwich the container wall surrounding the aperture when the nozzle is positioned in the aperture. At its second end, the nozzle preferably comprises a set of mating threads, capable of accepting a cap for preventing leakage of fluid articles from the container. The nozzle may also include a fluid flow regulator to control the flow of fluid articles out of the bag.

The self-erecting container may also include a nozzle guard capable of insertion between the nozzle detent and the corresponding container panel. The nozzle guard preferably has an inner peripheral shape substantially corresponding to at least a portion of the shape of the nozzle, so as to fit around at least a portion of the same. The nozzle guard stabilizes the nozzle in the panel aperture, and prevents movement of the nozzle back into the inner region of the container during filling operations.

To place the blank into a self-erecting and substantially collapsed orientation, the end panels are folded to overlay the bottom panel. In this position, two sets of paired corner panels overlay one side panel, while the other two sets of paired corner panels overlay the other side panel. One of each pair of corner panels is affixed to the opposed side panels, forming a container pocket having a substantially collapsed orientation. In this pre-erected and substantially collapsed orientation, the blank is substantially flat to facilitate shipment and storage thereof. Of course, a self-erecting orientation with the corner panels overlying and affixed to end panels is likewise contemplated.

Upon raising of the end or side panels, respectively, the corner panels cause the respective side or end panels to be automatically raised relative to the bottom panel, and the container pocket prompted to a substantially upright and expanded orientation.

In this orientation, the paired corner panels preferably protrude from the side panels, thus forming a containment ring for securing a filled bag in the container pocket.

The bag and attached nozzle may be inserted into the container pocket in either of the substantially collapsed and substantially expanded container orientations. If placed into a substantially collapsed container pocket, the bag and the container are both articulated to an erected and expanded orientation substantially concurrently. The weakened region surrounding the aperture allows the nozzle and nozzle detent to be forced through the aperture, while the aperture returns to its original form after positioning of the nozzle. The detent not only stabilizes the nozzle in the aperture, but also preferably prevents the nozzle from collapsing into the inner region of the container upon filling the bag with fluid articles. The nozzle guard may also be positioned between the nozzle detent and the corresponding container panel at this time.

The top panels are then folded over the substantially expanded container pocket and bag therein, such that the handle panels are substantially juxtaposed. The handle panels may be secured by any one of the handle securing elements, or any combination thereof. In a preferred embodiment, the locking tab first locks the handle panels in their substantially juxtaposed orientation, before handle support panels are positioned at least partially over the handle panels such that the juxtaposed projecting locking members pass through the slots in the handle support panels.

In a preferred embodiment, the projecting locking members are configured to releasably retain the handle support panels. The handle support panels not only lock the handle panels together, but also facilitate a more uniform distribution of the stress placed upon the handle panels over the entire container apparatus during use thereof.

The fully articulated container may be filled by inserting fluid articles through the nozzle and into the bag. Such filling may be performed when the container rests on the bottom panel, or in a preferred embodiment, by resting the container on the end panel opposite the aperture and nozzle. The cap may then be placed over the nozzle to prevent leakage during transportation, storage and use thereof.

When placed on the bottom panel in a carrying and dispensing orientation, the containment ring locks the filled bag into place during transportation and dispensing of the fluid articles. Moreover, the container expansion boundary, defined by the bottom panel, end panels, side panels, and paired corner panels, minimizes expansion and herniation of the fluid filled bag beyond the container pocket and through any container cracks or seams.

In a preferred embodiment, the self-erecting container apparatus has a substantially trapezoidal shape, with an angled or ramped top. Such a shape not only facilitates the dispensing of fluid articles, but also reduces the amount of blank material required to form the container. However, other shapes such as substantially square or rectangular are likewise contemplated.

In another preferred embodiment of the self-erecting container apparatus, the aperture is positioned in the bottom panel. While blank articulation remains substantially unchanged, the orientation of the self-erecting container apparatus differs. Instead of resting on the bottom panel in the primary carrying and dispensing position, the container rests on an end panel. Moreover, the container apparatus may also include a second aperture, and an associated fluid conduit positioned therein. The fluid conduit is preferably in fluid communication with the inside of the fluid article holding bag, such that the bag may be filled from a second, alternative location—without changing the orientation of the container. Additionally, the bag may be filled with fluid articles through one aperture, and dispensed from another.

Likewise, in another preferred embodiment, the self-erecting container includes a second support handle to provide an additional carrying mechanism.

In yet another preferred embodiment of the self-erecting container apparatus, the handle support panels are replaced by handle locking panels emanating from the end panels. The handle locking panels each include a slot for accepting and securing the handle panels in a substantially juxtaposed position. In particular, after the handle panels are juxtaposed, the handle locking panels are folded down over the handle panels such that the handle panels extend through the slots, thus securing the same. In a preferred embodiment, the slots comprise two larger openings separated by a cut line, so that the larger openings surround the base of the handle panels, while still precluding dislodgment of the handle locking panels from their articulated position. The handle locking panels facilitate a more uniform distribution of stress placed upon the handle panels during carrying and dispensing operations.

In a preferred embodiment, one of the handle support panels further includes a collar panel foldably emanating therefrom. The collar panel includes an inner peripheral region, which at least partially corresponds to at least a portion of the nozzle. The collar panel may be inserted between the nozzle detent and the corresponding container panel to secure the attached handle locking panel in place. Additionally, the collar panel also serves to secure the nozzle in place and prevent movement of the nozzle back into the inner region of the container.

In each embodiment of the invention, the container blank may be fabricated from at least one of the following materials: paper, paperboard, cardboard, corrugated paperboard. Each container may be fabricated from a blank of container material having inner and outer surfaces, either surface having a layer of unlined corrugated medium disposed thereon, or being coated with a waterproof or leakproof substance. Additionally, the container may be coated with a plastic sheet to likewise resist water or other liquids.

DETAILED DESCRIPTION OF THE INVENTION

Figure 1:
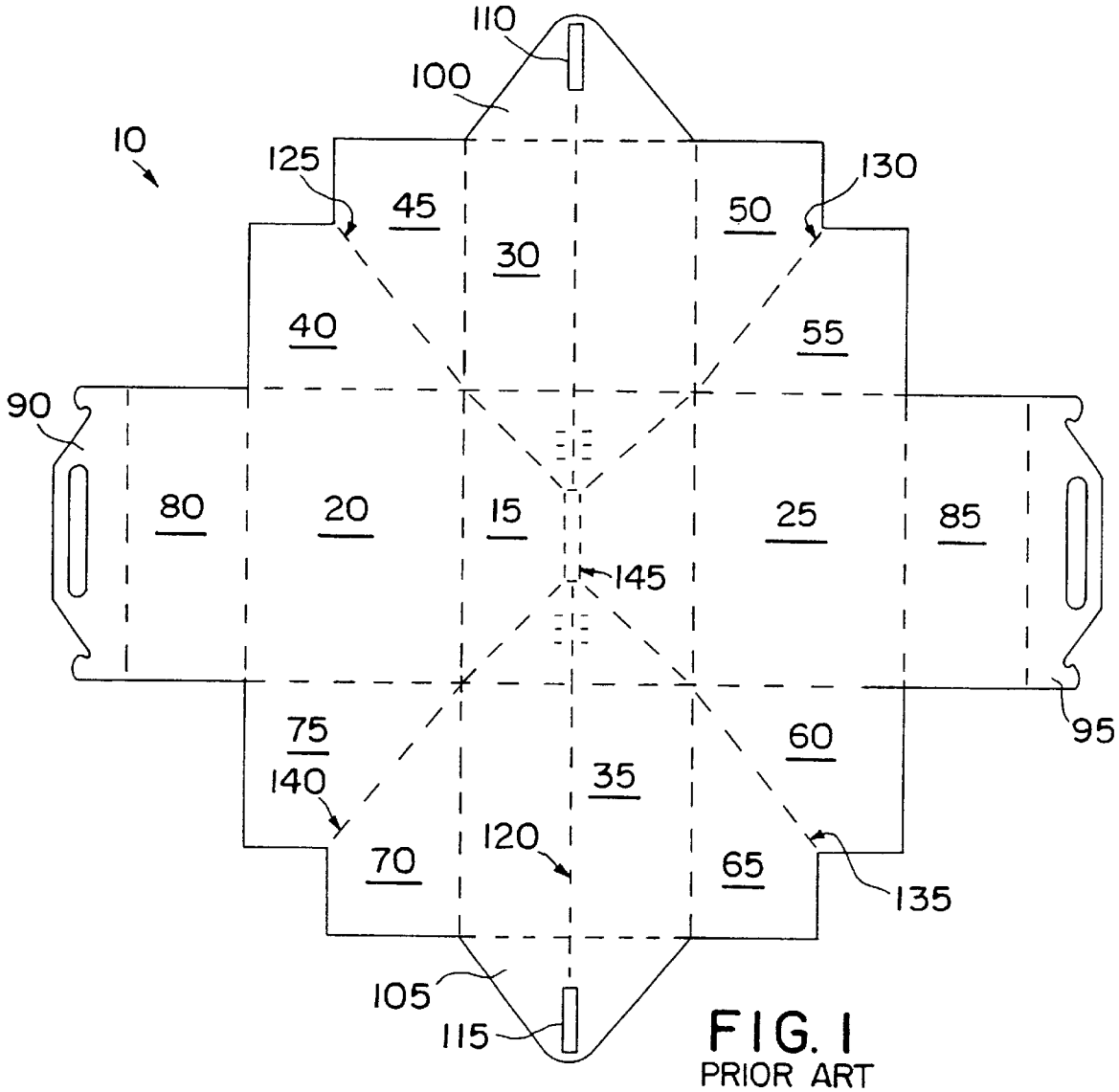
FIG. 1 PRIOR ART
FIG. 1 is a plan view of a blank for a prior art self-erecting container apparatus.

While this invention is susceptible of embodiment in many different forms, there is shown herein in the drawings and will be described in detail specific embodiments, with the understanding that the present disclosure is to be considered as an exemplification of the principles of the invention and is not intended to limit the invention to the embodiment illustrated.

FIG. 1 is a plan view of a prior art self-erecting container, corresponding to The Ice Cube™ corrugated cooler container manufactured by Wesland Container of Little Rock, Ark. Blank 10 comprises a bottom panel 15, side panels 20 and 25, end panels 30 and 35, paired corner panels 40 and 45, 50 and 55, 60 and 65, and 70 and 75. The corner panels are dimensioned and configured so that 40 is a mirror image of 45, 50 is a mirror image of 55 and so on. Top panels 80 and 85 have handles 90 and 95 emanating from them. Locking panels 100 and 105 emanate from top edges of ends panels 30 and 35, respectively, and are provided with slots 110 and 115 which engage hooks on handles 90 and 95, as illustrated. Fold lines separate each of the panels, as indicated by the broken lines. In addition, fold line 120 bisects blank 10. Diagonal fold lines 125, 130, 135 and 140 bisect each of the pairs of corner panels, and extend in straight lines into bottom panel 15, as shown in FIG. 1. In addition, a series of fold lines in the central area of bottom panel 15 define a rectangular area 145.

The manner of erecting the container 10, is as follows. Assume that the view of the blank, as shown in FIG. 1, is the inside surface of the container. As side panels 20 and 25 and end panels 30 and 35 are folded relative to bottom panel 15 toward the viewer, the diagonally extending fold lines between the respective corner panels 40, 45; 50, 55; 60, 65; and 70, 75 are forced inward so that the respective corner panels fold toward one another away from the viewer. Thus, when the side panels and end panels have attained a position which is substantially perpendicular to the bottom panel, the juxtaposed corner panels are to the inside of the substantially erected container.

During the folding and erecting process, adhesive is applied to the sides of one or both of each pair of corner panels on the side opposite the sides presented in FIG. 1, so that the corner panels become glued to one another. In addition, adhesive is applied to the "inside" surface of each of corner panels 40, 55, 60 and 75 to hold the juxtaposed paired corner panels against the inner surfaces of side panels 20 and 25. To close the lid/handle structure, top panels 80 and 85 are folded over toward one another so that they form a flat lidded structure. Handles 90 and 95 will become juxtaposed and will extend upwardly perpendicular to the top and bottom panels of the container. Locking panels 100 and 105 are then folded up and engage the hooks on the juxtaposed handles 90 and 95.

Once the container has been erected and glued as described, by exerting pressure on the side panels 20 and 25 toward one another, end panels 30 and 35 and their respective locking panels 100 and 105 will fold inwardly about the elongated fold line 120. At the same time, the bottom panel will collapse upon itself about the several fold lines 125–140 and about rectangular fold line 145, so that the collapsed bottom panel 15 projects outwardly, in the shape of a trapezoid. Thus, the entire structure can be substantially flattened so that side panels 20 and 25 become juxtaposed to one another.

Figure 2:
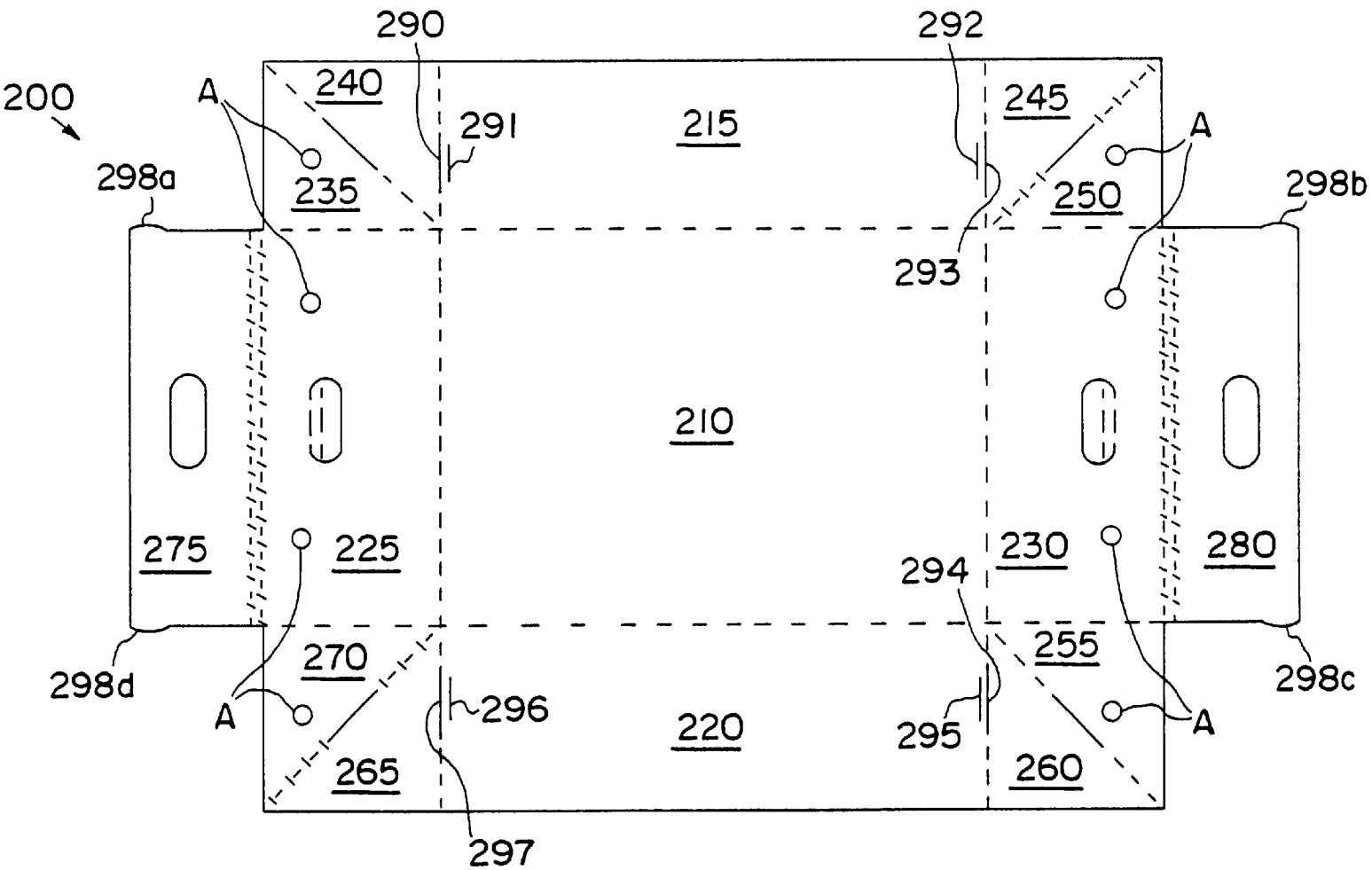
FIG. 2 is a plan view of a blank for a self-erecting container apparatus according to one embodiment of the present invention.

FIG. 2 illustrates a blank for a self-locking, self-erecting container according to an embodiment of the present invention. Blank 200 comprises bottom panel 210, side panels 215 and 220, end panels 225 and 230, paired corner panels 235, 240, 245, 250, 255, 260, 265 and 270. Locking panels 275 and 280 emanate from "upper" edges of end panels 225 and 230, respectively. Blank 200 is also provided with through-cuts 290, 291; 292, 293; 294, 295; and 296, 297.

Figure 2A:
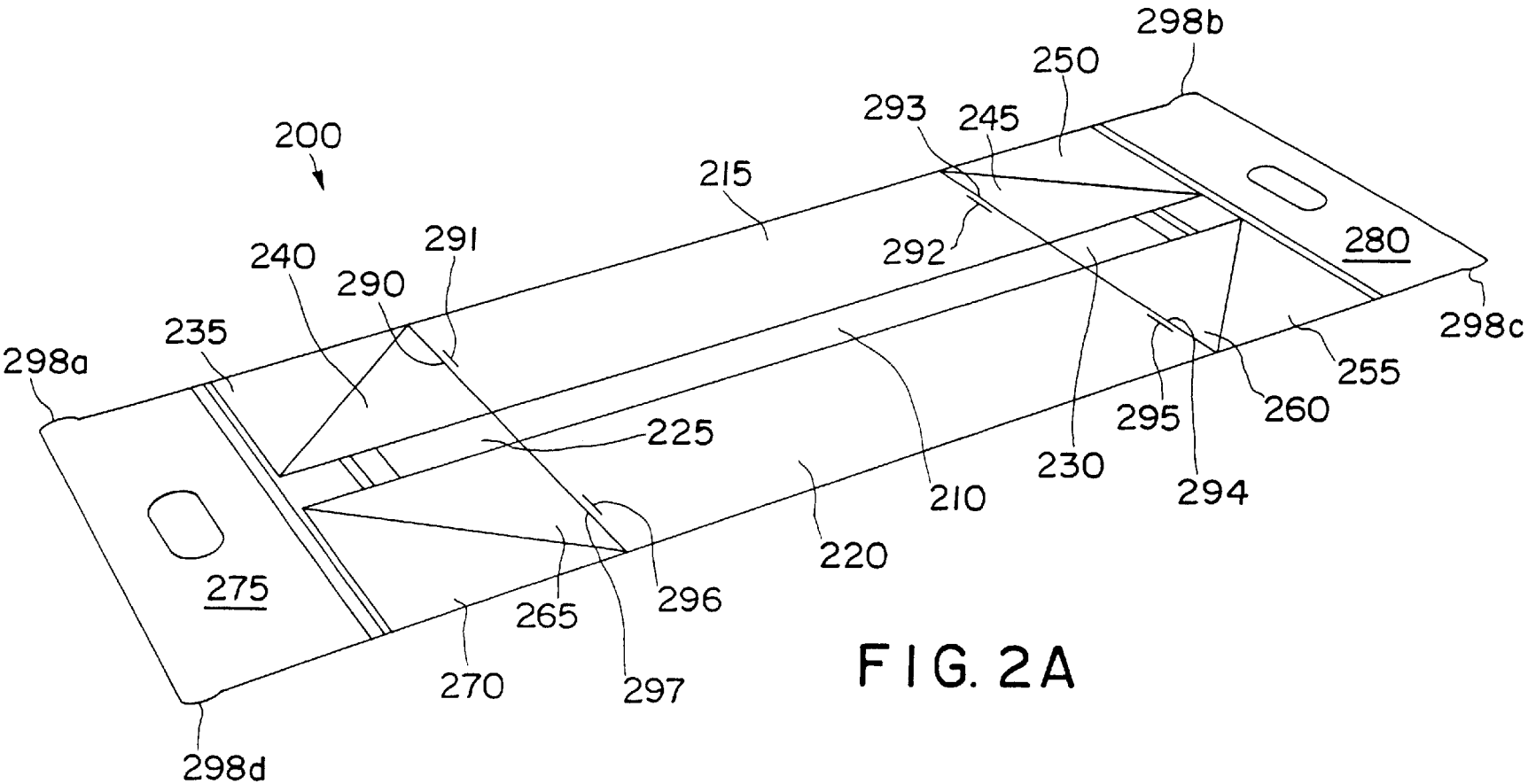
FIG. 2A is a perspective view of the folded and glued blank for the self-erecting container apparatus of FIG. 2.

To place the blank 200 into the self-erecting orientation, as shown in FIG. 2A, side panels 215 and 220 are folded about their respective fold lines to overlay bottom panel 210, as the side panels are folded, adhesive is applied to corner panels 235, 250, 255 and 270 only against end panels 225 and 230, respectively. The adhesive is applied at one or more regions of each of panels 235, 250, 255 and 270 which include at least areas central to the panel. Adhesive may be applied from such central regions outwardly to the edges, if desired, but some adhesive needs to positioned at least in the central region of each of the respective panels (locations "A", generally, in FIG. 2) in order to securely affix them to end panels 225 and 230, respectively.

After the adhesive has set, upon raising side panels 215 and 220 to positions perpendicular to bottom panel 210, corner panels 240, 245, 260 and 265 pull against the corner panels 235, 250, 255 and 270 which have been fixedly attached to end panels 225 and 230. End panels 225 and 230 are pulled upwardly into positions perpendicular to bottom panel 210 and corner panels 240, 245, 260 and 265 become juxtaposed to their respective mated corner panels 235, 250, 255 and 270, respectively.

In order to lock the tray into its erected configuration, locking panels 275 and 280 are folded inward and into juxtaposed positions overlying end panels 225 and 230, respectively. Locking panels 275 and 280 are provided with rounded projections 298*a* 298*d*, as shown in FIG. 2, which, when locking panels 275 and 280 are folded inward, press into and push outwardly, the regions of panel material between the respective through-cuts 290, 291; 292, 293; 294, 295; and 296, 297 to create an interference fit between the projections and the opposing edges of the through-cuts. The locking panels are held in their inwardly and downwardly folded positions to maintain the side and end panels in their raised orientations relative to the bottom panel.

Once the tray has been erected, the way to collapse the tray is to pull the locking panels upward and outward to overcome the interference fit of the projections. Then the side panels may be folded flat against bottom 210 to create a substantially flattened self-erecting tray. Since the through-cuts are provided, as well as the handle holes, yielding leakage paths, the container of FIG. 2 is not a "slotless" container.

Figure 3A:
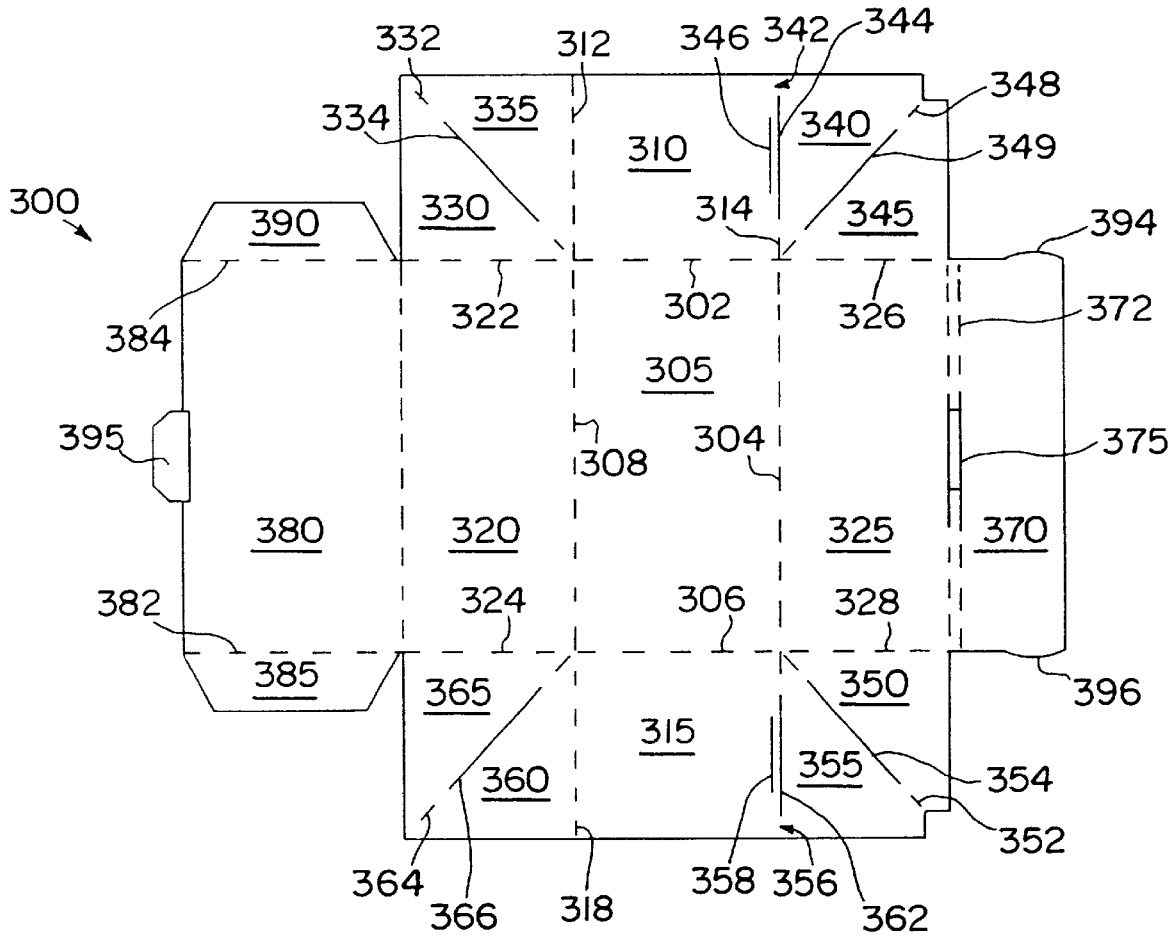
FIG. 3A is a plan view of a blank for a self-erecting container apparatus according to one embodiment of the present invention.

FIG. 3A illustrates a blank corresponding to a self-erecting container according to another embodiment of the invention. Blank 300 includes bottom panel 305, side panels 310 and 315, and end panels 320 and 325. Mated corner panels 330, 335; 340, 345; 350, 355; and 360, 365 are provided in the usual manner. A locking panel 370 emanates from the upper edge of end panel 325 and has a slot 375 provided at a position approximately midway along the length of the double scored fold between end panel 325 and locking panel 370.

Blank 300 is also provided with score lines 302, 304, 306, 308, 312, 314, 318, 322, 324, 326, 328, 332, 342, 348, 352, 356, 364, 382, 384 and 397. In a preferred embodiment of the invention, each of the score lines is actually a series of short cuts completely through the blank material, for facilitating ready folding of the container blank. In addition, blank 300 preferably is also provided with double score line 372, and elongated slits 334, 349, 354 and 366. Paired slits 344 and 346, and 358 and 362 are provided to cooperate with projections 394 and 396, as described hereinafter.

Figure 3B:
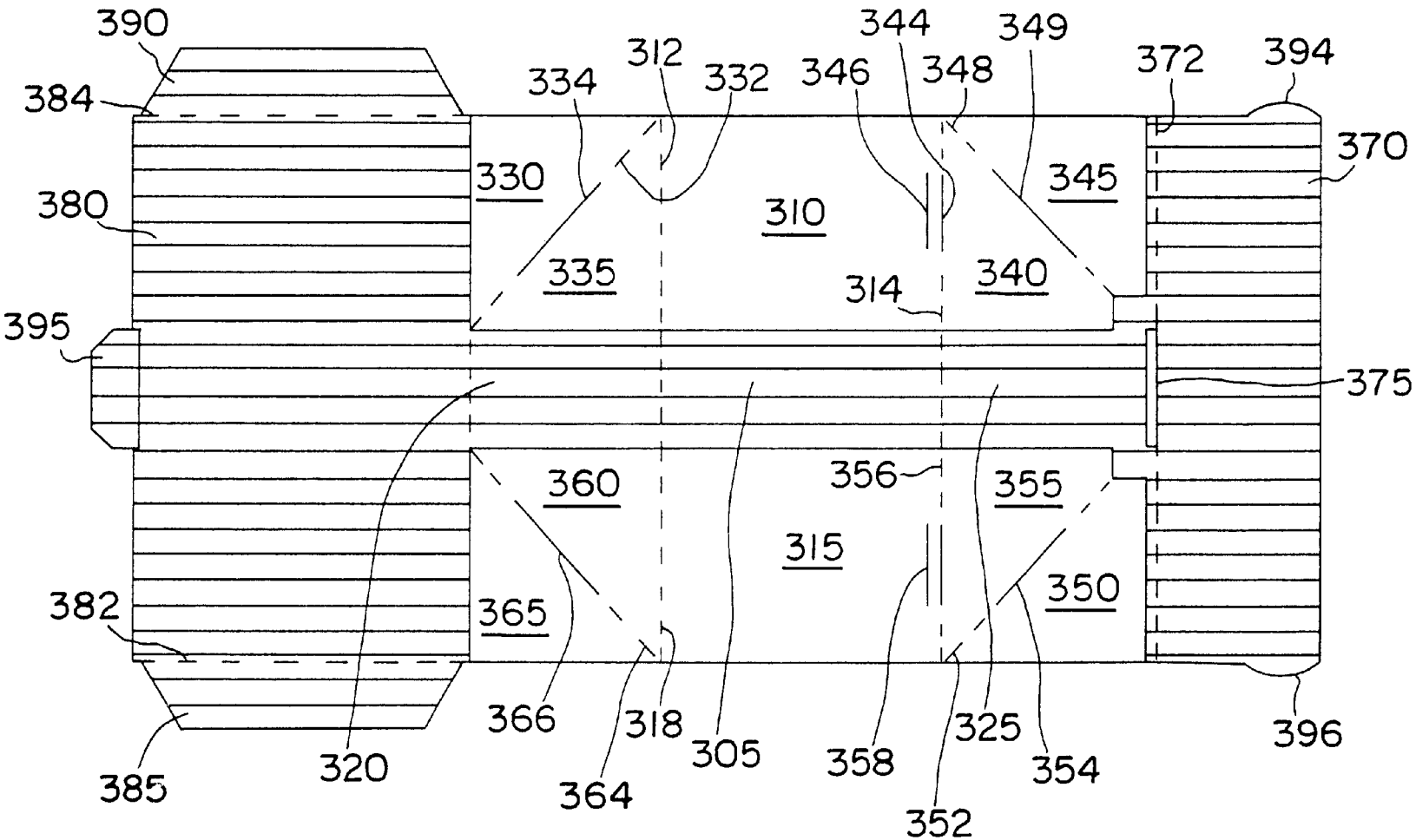
FIG. 3B is a plan view of the folded and glued blank of FIG. 3A, prior to raising of the side panels.

The "outer" corners of locking panel 370 are provided with projections 394, 396. A lid 380 emanates from the upper edge of end panel 320 and is provided with side panels 385 and 390 and a locking tab 395. Preparation of the blank into the self-erecting configuration is accomplished by folding side panels 310 and 315 over into juxtaposed positions relative to bottom panel 305, while applying adhesive to the inside surfaces of corner panels 330, 345, 350 and 365. This configuration is shown in FIG. 3B.

Figure 3C:
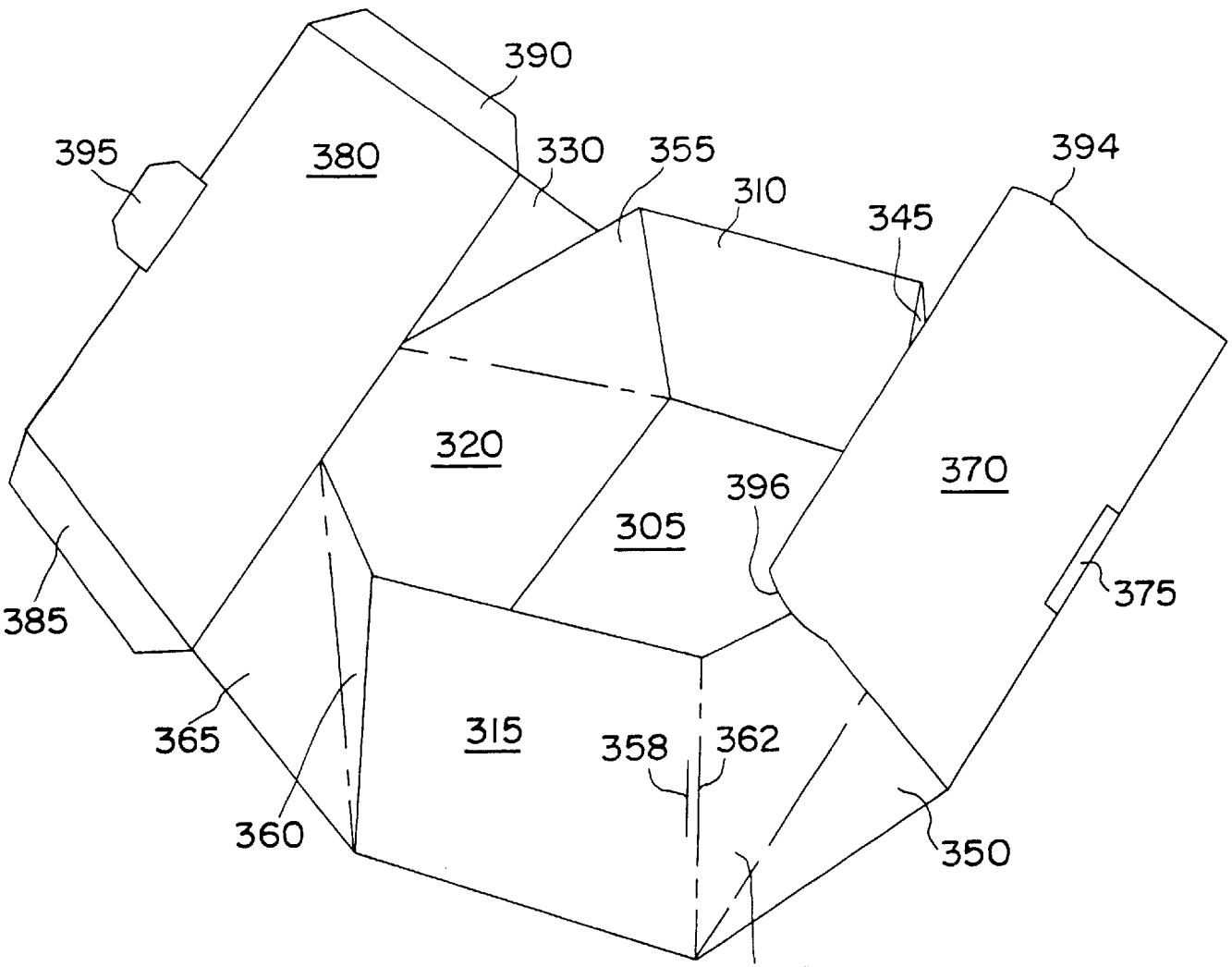
FIG. 3C is a perspective view of the blank of FIGS. 3A and 3B, showing the side panels partially raised, with the corner panels pulling the end panels upward.

Once the adhesive has set, upon pulling side panels 310 and 315 upward into perpendicular positions relative to bottom panel 305, corner panels 335, 340, 355 and 360 pull end panels 320 and 325 about their respective fold lines into perpendicular positions relative to bottom panel 305. FIG. 3C illustrates the configuration of the container, as the side panels 310 and 315 are being pulled upward, toward their positions perpendicular to the bottom panel 305. The corner panels can be seen to "pull" end panels 320 and 325 upwardly, toward the perpendicular, relative to bottom panel 305.

Alternatively, once the adhesive has set, upon pulling end panels 320 and 325 upward into perpendicular positions relative to bottom panel 305, corner panels 335, 340, 355 and 360 pull side panels 310 and 315 about their respective fold lines into perpendicular positions relative to bottom panel 305. FIG. 3C illustrates the configuration of the container, as the end panels 320 and 325 are being pulled upward, toward their positions perpendicular to the bottom panel 305. The corner panels can be seen to "pull" side panels 310 and 315 upwardly, toward the perpendicular, relative to bottom panel 305. That is, the self-erecting action is obtained whether the side or the end panels are the ones grasped and pivoted relative to the bottom. This is true for all of the other embodiments of the invention, of FIGS. 4–6, as well.

Locking panel 370 is then folded inward and downward, so that projections 394 and 396 engage and press outwardly the blank material between paired slits 344, 346 and 358, 362, to create an interference engagement of the projections, to affix at least end panel 325 into its perpendicular orientation relative to bottom panel 305.

To close the container and simultaneously affix end panel 320 into its perpendicular orientation relative to bottom panel 305, top panel 380 is folded over and perpendicular to end panel 320 with tabs 385 and 390 being folded perpendicular to top panel 380. Locking is achieved by inserting tab 395 into slot 375. The container of FIG. 3A is likewise not a "slotless" container, in view of the many perforations, and slits through its blank.

In a preferred embodiment of the container of FIG. 3A, the surface of the blank, which will become the inner surface, may be covered by non-lined corrugated medium, as shown in FIG. 3B. The unlined corrugated material will provide a plurality of resiliently yielding ridges which will act as dunnage surfaces, to provide cushioning from blows to the package. Depending upon their depth, the ridges may be used to help locate and position articles within the container. The corrugated medium on the inner surface of the blank is shown only in FIG. 3B, for ease of illustration of the container and its blank.

Figure 4:
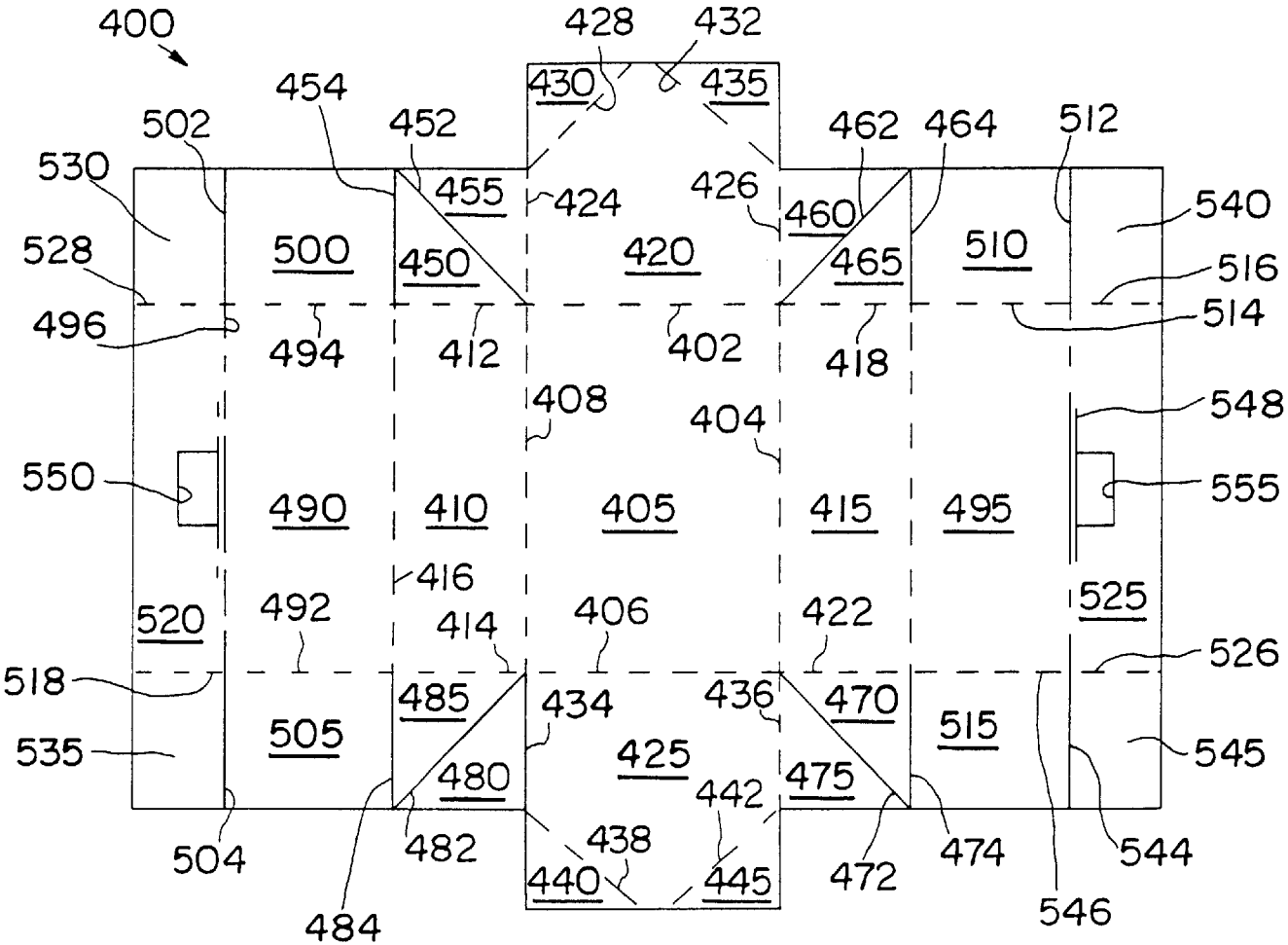
FIG. 4 is a plan view of a blank for a self-erecting container apparatus according to another embodiment of the present invention.

FIG. 4 is an illustration of a blank for a self-erecting container for another embodiment of the invention. Blank 400 comprises bottom panel 405, side panels 410 and 415, and end panels 420 and 425. Pentagonal end panels 420 and 425 are provided with lid support panels 430, 435, 440 and 445. Blank 400 also includes corner panels 450, 455, 460, 465, 470, 475, 480 and 485. Lid panels 490 and 495 emanated from upper edges of side panels 410 and 415 respectively. Top support panels 500, 505, 510 and 515 emanated from end edges of top panels 490 and 495 respectively. Handle panels 520 and 525 emanate from upper edges of top panels 490 and 495 respectively. Handle support panels 530, 535, 540 and 545 emanate from end edges of handle panels 520 and 525 respectively. Handle panels 520 and 525 are provided with die-cut gripping apertures 550 and 555 respectively.

Blank 400 is provided with fold lines 402, 404, 406 and 408, which preferably do not involve puncturing or piercing the blank material. Score lines 412, 414, 416, 417, 418, 422, 528, 494, 428, 432, 424, 426, 514, 516, 496, 518, 492, 546, 526, 434, 438, 442, 436, and 548 may, in a preferred embodiment, comprise a series of through-cuts or perforations, for facilitating folding of the container material. Lines 502, 454, 452, 504, 484, 482, 472, 474, 544, 462, 464, and 512 preferably comprise complete cuts along their length, except at the peripheral edges of the blank where intermittent through-perforations are provided, in order to hold the adjoining panels together, during the folding and gluing steps described hereinafter.

To place the blank 400 into condition for self-deployment, end panels 420 and 425 are initially folded over into overlying relation juxtaposition relative to bottom panel 405. Simultaneously, panels 530 and 535 are affixed to handle panel 520, support panels 500 and 505 are affixed to top panel 490, and corner panels 450 and 485 are affixed to side panel 410. Comer panels 465 and 470 are affixed to side panel 415, support panels 510 and 515 are affixed to top panel 495 and support panels 540 and 545 are affixed to handle panel 525.

Upon pulling up of end panels 420 and 425 relative to bottom panel 405, side panels 410 and 415 are raised to perpendicular positions relative to bottom panel 405. Top support panels 430, 435, 440 and 445 are folded inward, to positions perpendicular to end panels 420 and 425. The top support panels 430, 435, 440 and 445 help support the top panels, and help prevent them from being pushed down between end panels 420, 425. The other support panels help provide rigidity and strength to the entire container structure, as well as to the specific panels which they support. Top panels 495 and 490 are brought against the edges of the peaks of end panels 420 and 425, to produce a peaked roof for the container. Handle panels 520 and 525 are brought into juxtaposition to one another, in positions perpendicular to bottom panel 405. In order to facilitate keeping the container in a closed orientation, one of the tabs produced by the die-cutting of gripping apertures 550 and 555 may be left connected to the blank and not fully severed so that it can be pushed through the opposite corresponding handle aperture and folded upward to interlock the handle panels together.

Figure 5:
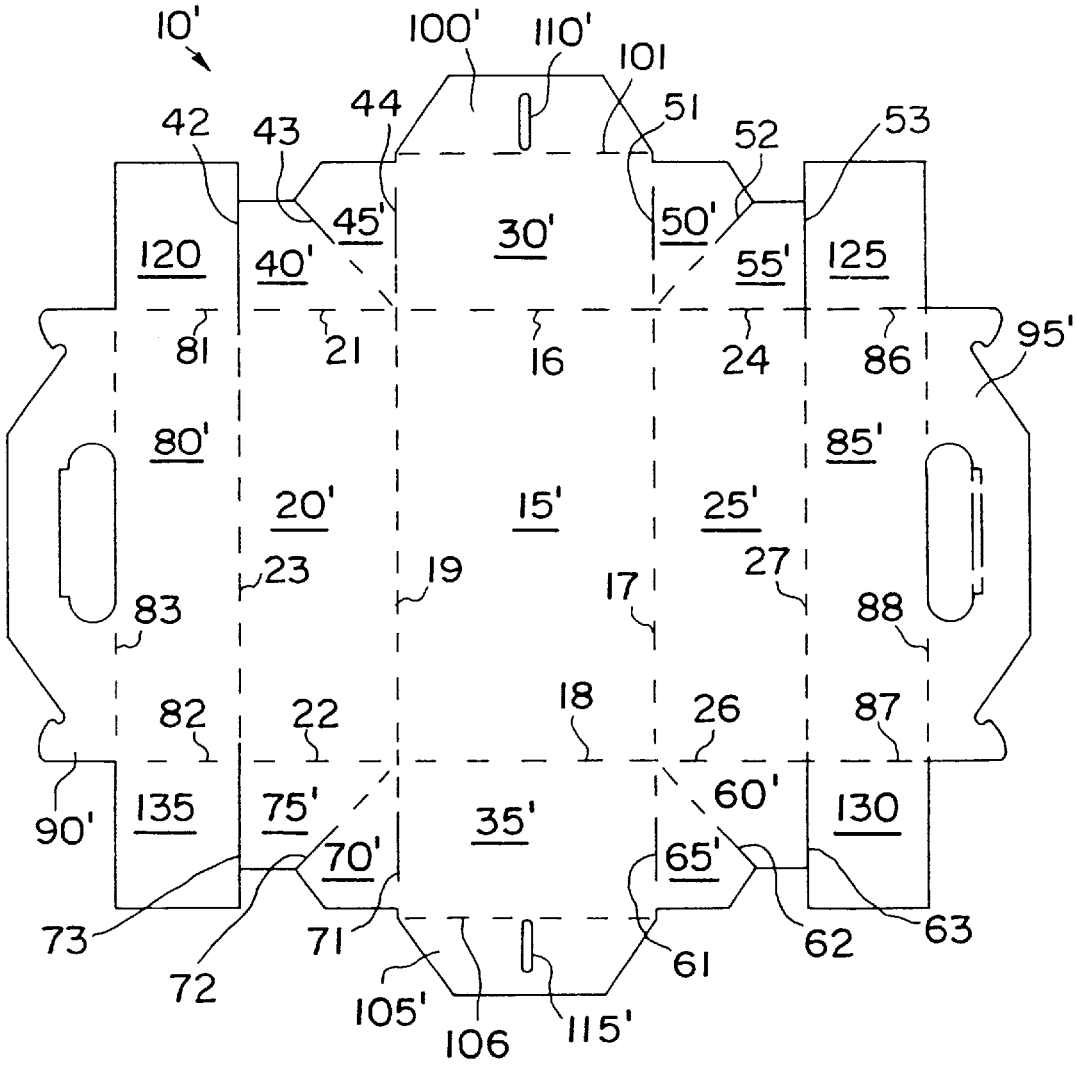
FIG. 5 is a plan view of a blank for a self-erecting container apparatus according to another embodiment of the present invention.

FIG. 5 is an illustration of a blank for a self-erecting container corresponding to still another embodiment of the invention. The overall layout in terms of the number of panels and their relationships to one another in the embodiment of FIG. 5 is as follows.

Blank 10' comprises a bottom panel 15', side panels 20' and 25', end panels 30' and 35', corner panels 40', 45', 50', 55', 60', 65', 70' and 75'. Top panels 80' and 85' have handles 90' and 95' emanating from them. Locking panels 100' and 105' emanate from top edges of ends panels 30' and 35', respectively, and are provided with slots 110' and 115' which engage hooks on handles 90' and 95', as illustrated.

Blank 10' is provided with fold lines 16, 17, 18, 19, 21, 22, 23, 24, 26, and 27, 44, 51, 61, 71, 81, 82, 86, 87, 101 and 106, which preferably do not involve puncturing or piercing the blank material. Score lines 42, 53, 63 and 73 preferably are double score lines, with perforations extending completely through the blank material for facilitating folding of the container material. Lines 88 and 83 preferably are single score lines, with perforations extending completely through the blank material. Additionally, diagonal score lines 43, 52, 62 and 72 separating the paired corner panels preferably are single score lines, with perforations or substantially elongated cuts.

To create the partially erected container, end panel 30' and its corresponding panels 120, 40', 45', 50', 55' and 125 are folded over toward the center of the blank, into juxtaposed overlying relation to bottom panel 15', and panels 80', 20', 25' and 85'. Panel 40' is affixed to panel 20', and panel 55' is affixed to panel 25'. End panel 35' and its corresponding panels 135, 75', 70', 65', 60' and 130 are folded over toward the center of the blank, into juxtaposed overlying relation to bottom panel 15'. Panel 135 is affixed to panel 120, panel 75' is affixed to panel 20', panel 60' is affixed to panel 25' and panel 130 is affixed to panel 125. In one preferred embodiment, in which the bottom panel is approaching a square, and the height of the end and side panels are close to the length and width of the bottom panel, the panels may be sized and proportioned so that, upon such folding, panel 70' overlaps panel 45', end panel 35' and locking panel 105' overlap end panel 30', and panel 65' overlaps panel 50'. Depending upon the relative proportions of the length, width and height of the container to be formed, the aforementioned overlapping may not take place, or may be provided to a greater or lesser degree.

Assume that the view of the blank, as shown in FIG. 5, is the inside surface of the container. As side panels 20' and 25' and end panels 30' and 35' are folded relative to bottom panel 15' toward the viewer, the diagonally extending fold lines between the respective corner panels 40', 45'; 50', 55'; 60', 65'; and 70', 75' are forced inward so that the respective corner panels fold toward one another away from the viewer. Thus, when the side panels and end panels have attained a position which is substantially perpendicular to the bottom panel, the juxtaposed corner panels are to the inside of the substantially erected container.

During the folding and erecting process, adhesive is applied to the sides of one or both of each pair of corner panels on the side opposite the sides presented in FIG. 5, so that the corner panels become glued to one another. In addition, adhesive is applied to the "inside" surface of each of corner panels 40', 55', 60' and 75' to hold the juxtaposed paired corner panels against the inner surfaces of side panels 20' and 25'. To close the lid/handle structure, top panels 80' and 85' are folded over toward one another so that they form a flat lidded structure. Handles 90' and 95' will become juxtaposed and will extend upwardly perpendicular to the top and bottom panels of the container. Locking panels 100' and 105' are then folded up and engage the hooks on the juxtaposed handles 90' and 95'.

Top panel supports 120, 125,130 and 135 emanate from end edges of top panels 80' and 85'. In a preferred embodiment of the invention, there is a difference in the relative proportions of the respective support panels 120, 125, 130 and 135, so that support panels 130 and 135, for example, are longer than support panels 120 and 125. When end panels 30' and 35' are folded over bottom panel 15', panels 135 and 130 overlap panels 120 and 125, and the support panels are adhered to one another in the overlapping.

Adhesive is applied between panels 40' and 75' and side panel 20' and between panels 55' and 60' and panel 25'. In addition, where panels 120 and 135 overlap, they are affixed to one another with adhesive and where panels 125 and 130 overlap one another, they are affixed to each other with adhesive. However, panels 120 and 135 are not affixed in any manner to panel 80' and panels 125 and 130 are not affixed in any manner to 85'. Panels 120 and 135, and 125 and 130, thus create a separate inner top panel to the container apart from panels 80' and 85'. When the joined panels 120 and 135, and 125 and 130, are brought into overlapping parallel relationship to bottom panel 15', the end edges of panels 120,125,130 and 135 are abutted by the bottoms of locking panels 100' and 105'.

Since the support panels 120,125, 130 and 135 are not adhered to top panels 80' and 85', the overlapped and adhered support panels together create a separate reinforcing top, the ends of which bear against the end panels 30' and 35' where they meet locking panels 100' and 105', thus providing enhanced lateral strength, to prevent collapsing of end panels 30' and 35' toward one another.

Paired corner panels 40' and 45', 50' and 55', 60' and 65', and 70' and 75' are not mirror images of one another. The adhesively affixed corner panels, 40', 55', 60' and 75', are right trapezoids, with two parallel edges. The non-affixed corner panels, 45', 50', 65', and 70', are right trapezoids, with no parallel edges. Accordingly, when the container is fully erected, diagonal fold lines 43, 52, 72 and 62 do not extend to the top edge of side panels 20' and 25', and thus the completed container is not a slotless, leakproof container.

Figure 6:
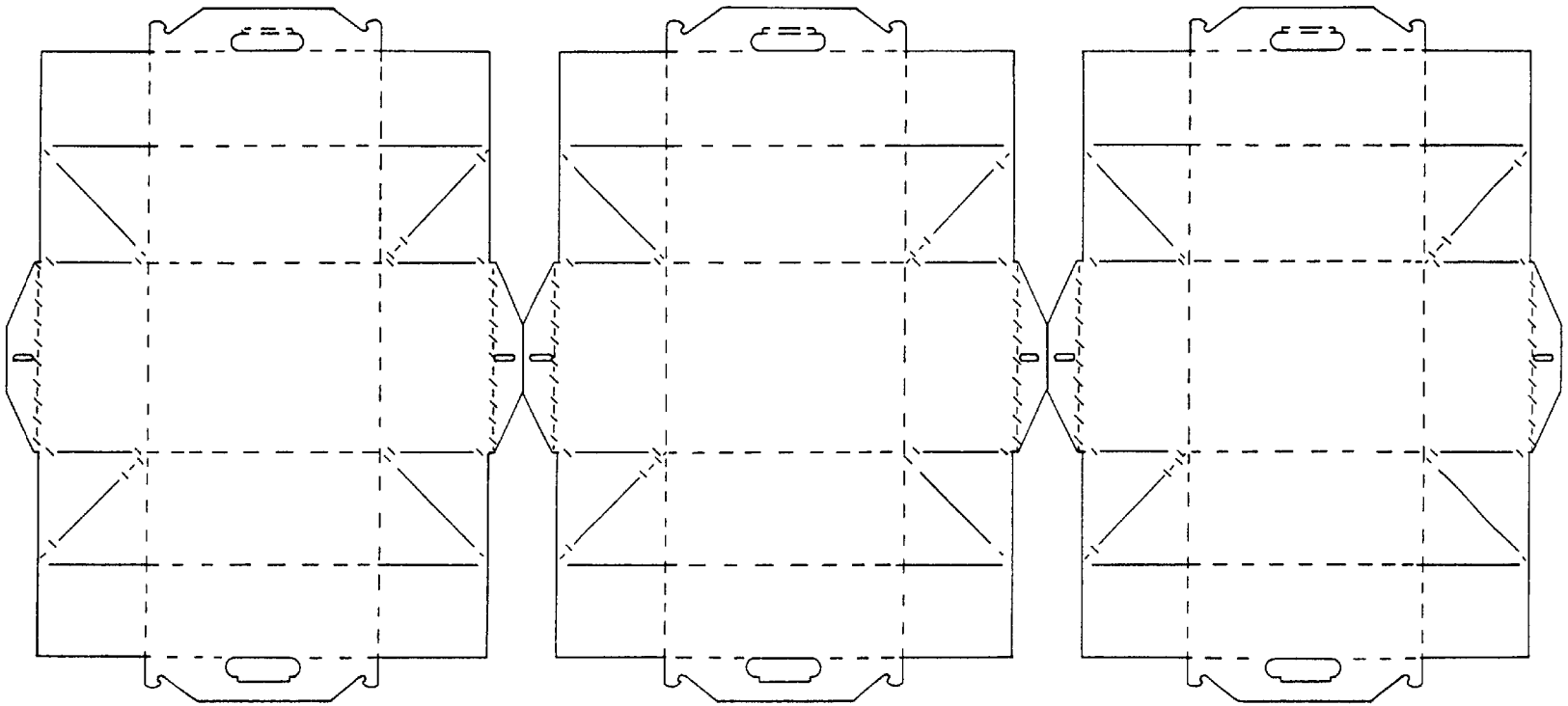
FIG. 6 is a plan view of multiple blanks for a self-erecting container apparatus according to another embodiment of the present invention.

A further embodiment of the invention is illustrated in FIG. 6. The container of FIG. 6 is formed from a blank which is substantially similar to that of FIG. 5 (apart from the dimensions and proportions of the particular panels, which may vary from application to application, in a manner readily understandable by one of ordinary skill in the art having the present disclosure before them. Accordingly, only the salient differences between the embodiments of FIGS. 5 and 6 will be discussed in detail. In the embodiment of FIG. 6, the paired corner panels are substantially mirror images of each other, and each pair of corner panels forms a square. Further, the diagonal score lines separating the paired corner panels may be perforations or substantially elongated cuts. The support panels emanating from the top panels preferably may be connected to their adjoining corner panels by score lines which likewise may be perforations or substantially elongated cuts.

As a manufacturing method, the blanks may be die-cut, in a manner such that three (or more or less) blanks may be cut at the same time, from a single uncut sheet of container material, with the blanks being connected end-to-end (or side-to-side) by perforated regions for easy separation, as shown in FIG. 6.

Figure 7:
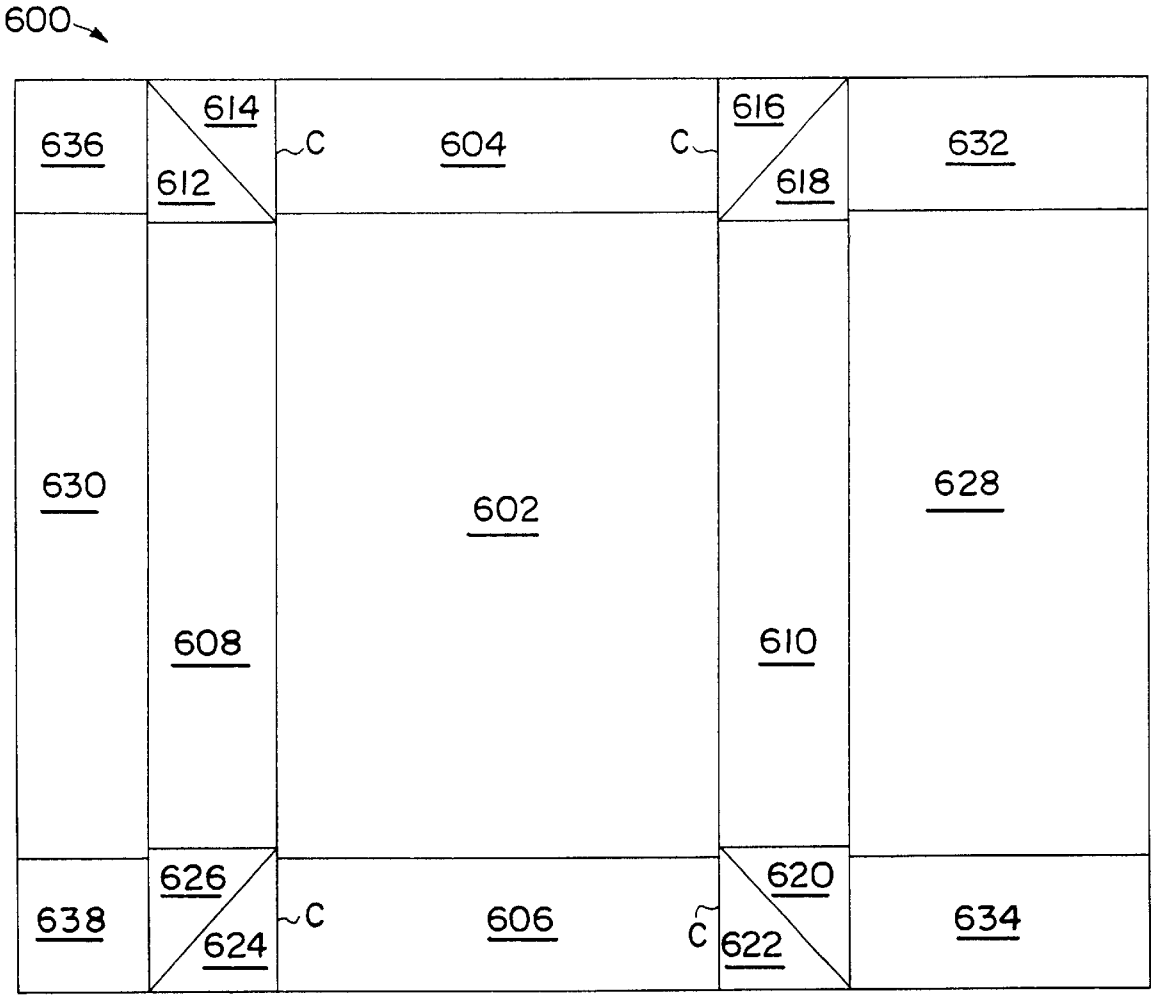
FIG. 7 is a plan view of a blank for a self-erecting container apparatus according to yet another embodiment of the invention.

FIG. 7 shows a blank for a further embodiment of the present invention. Blank 600 includes bottom panel 602, end panels 604 and 606 and side panels 608 and 610. Blank 600 also includes corner panels 612, 614, 616, 618, 620, 622, 624 and 626. The aforementioned panels are all connected to each other by fold lines and without any cuts. In addition, top panels 628 and 630 emanate from side panels 610 and 608, respectively. Top support panels 632 and 634 emanate from top panel 628 and are separated therefrom by fold lines. Top support panels 636 and 638 emanate from top panel 630 and are separated therefrom by fold lines. Cuts separate corner panel 612 from top support panel 636; corner 618 from top support panel 632; corner panel 620 from top support panel 634; and corner panel 626 from top support panel 638.

In an alternative embodiment of the invention instead of fold lines, cuts C may be provided between the end panels 604 and 606 and their adjacent panels 614, 616 and 622 and 624, respectively.

In order to put the blank into orientation to form the self-erecting container, first, side panel 608 is folded to a position overlying bottom panel 602. In doing so, corner panel 614 takes a position overlying a portion of end panel 604 and corner panel 624 takes a position overlying a portion of end panel 606. Corner panels 614 and 624 are then adhesively adhered to end panels 604 and 606. Then, side panel 610 is folded to a position overlying bottom panel 602. Corner panel 616 is adhesively adhered to end panel 604 and corner panel 622 is adhesively adhered to end panel 606. It may be readily observed from FIG. 7 that because top panel 628 is substantially wider than top panel 630, when the aforementioned folding attachment has taken place, top panel 628 will actually overlie substantially all of bottom panel 602 and substantially all of top panel 630 and side panel 608.

To raise the container to its use configuration, end panels 606 and 604 may be folded upwards to positions perpendicular to bottom panel 602 which, in turn, will force side panels 608 and 610 to assume positions perpendicular to bottom panel 602. Pulling upward of folded-over panels 608 and 610 can accomplish the same end result. Top panels 628 and 630 then may be refolded over bottom panel 602 and top support panels 632 and 636, and 634 and 638, may be folded down to cover the sides of end panels 604 and 606, respectively. Top support panels 632, 634, 636 and 638 may be affixed in place to end panels 604 and 606 using any suitable method of attachment.

Figure 8:
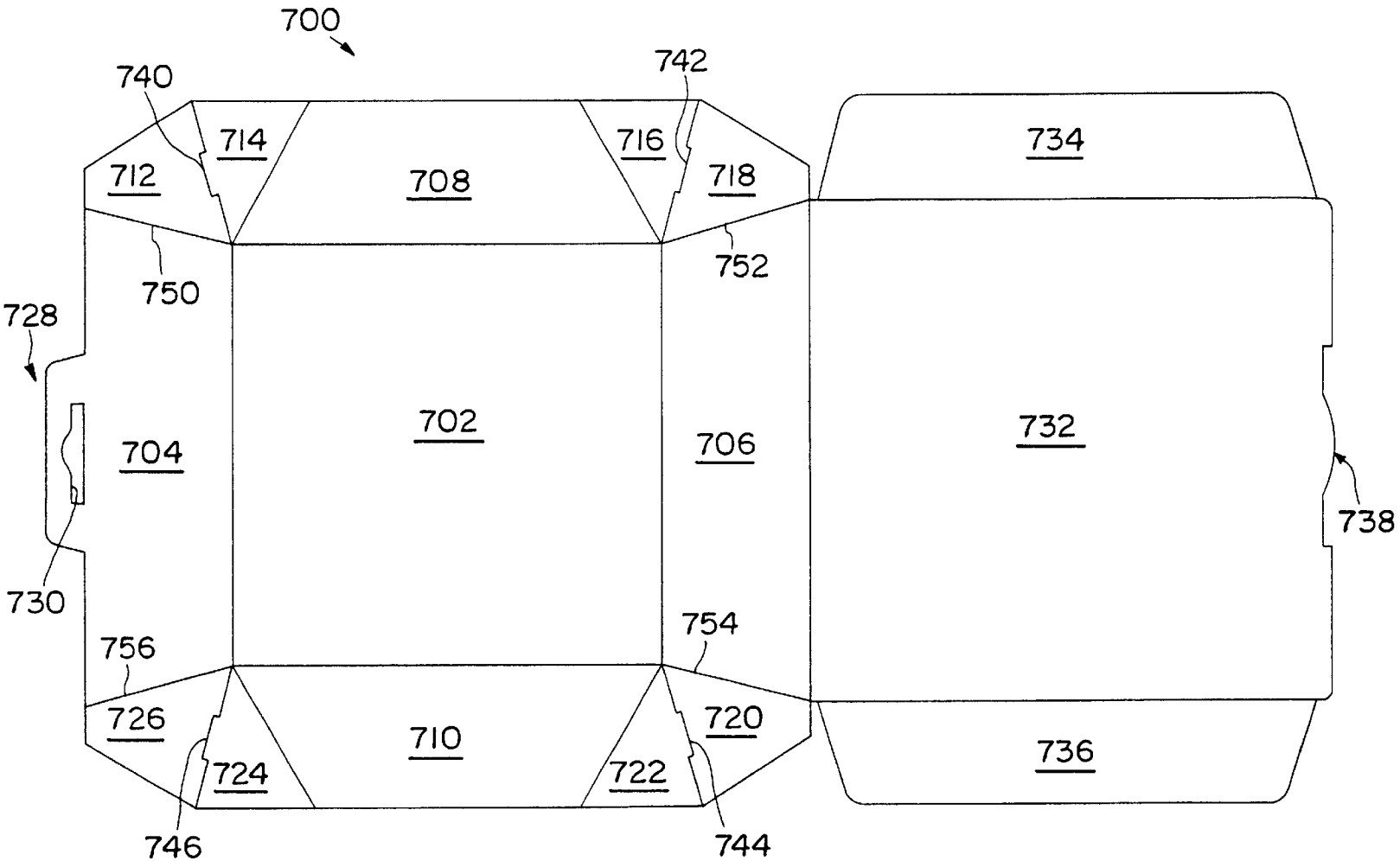
FIG. 8 is a plan view of a blank for forming a self-erecting container apparatus according to still yet another embodiment of the invention.

FIG. 8 is a plan view of a blank for still another embodiment of the invention.

Blank 700 includes bottom panel 702, end panels 704 and 706, side panels 708 and 710, and corner panels 712, 714, 716, 718, 720, 722, 724 and 726. Locking tab 728 emanates from end panel 704 and is provided with an aperture 730. Top panel 732 emanates from end panel 706 and has two top support panels 734 and 736 emanating from side edges therefrom. A locking tab 738 is formed on an edge of top panel 732, to engage aperture 730 in a manner to be described hereinafter. In one embodiment of the invention, C-shaped die cuts 740, 742, 744 and 746 are formed in the fold lines between the corner panels 712–714, 716–718, 720–722 and 724–726, respectively. In an alternative embodiment of the invention (not shown), the C-shaped die cuts may be omitted, leaving simple straight fold lines between each pair of adjacent corner panels.

Cuts 750, 752, 754 and 756 are provided between the end panels 704, 706 and their immediately adjacent corner panels 712, 718, 720 and 726, respectively.

To form the container, first, corner panels 714, 716, 722 and 724 are folded upward and inward about their common fold lines with their adjacent side panels 708 and 710. Then, end panels 704 and 706 are folded upward and inwardly. Corner panels 712, 718, 720 and 726 are in a juxtaposed underlying relation with inner surfaces of end panels 704 and 706, and adhered thereto. In the resulting configuration, the fold line between corner panels 712 and 714 is substantially aligned with the edge of end panel 704 resulting from cut 750; the fold line between corner panels 718 and 716 substantially aligns with the edge of end panel 706, resulting from cut 752; the fold line between corner panels 720 and 722 substantially aligns with the free edge of end panel 706 resulting from cut 754; and the fold line between corner panels 726 and 724 substantially aligns with the free edge of end panel 704 resulting from cut 756. The tabs in corner panels 714, 716, 722 and 724, resulting in C-shaped cuts 740, 742, 744 and 746, abuftingly engage the free edges of end panels 704 and 706 to facilitate alignment of the respective corner panels. Following such alignment, corner panels 712 and 726 are preferably adhesively adhered to the inside surface of end panel 704, and corner panels 718 and 720 are preferably adhesively affixed to the inside surface of end panel 706. Once the adhesive has been set, the resultant container comprises a bottom portion having a generally pyramidal shape with the attached top panel 732 and top support panels 734 and 736. The container can then be collapsed by folding end panels 704 and 706 inwardly about their respective fold lines they have in common with bottom panels 702. Simultaneously, side panels 708 and 710 are forced outwardly and downwardly to positions coplanar with bottom panel 702. Top panel 732 assumes a position partially overlying the flat-folded bottom of the container.

Erecting and closing the container is accomplished by raising up end panel 704 and 706, folding top support panels 734 and 736 to positions inward of the side edges of top panel 732, and thereafter folding top panel 732 to a position overlying and substantially parallel to bottom panel 702. Top support panels 734 and 736 will be slidingly received to positions inside of and adjacent side panels 708 and 710.

Upon the folding over of top panel 732 to a position overlying and substantially parallel to bottom panel 702, upon continued application of pressure, locking tab 738 will be forced passed the free edge of locking tab 728 and will enter into aperture 730 and project outwardly slightly beyond the aperture to provide positive locking interengagement of locking tab 738 with locking tab 728 to maintain the container in a substantially closed stable configuration. Release of the top panel is achieved by a combination of pulling locking tab 728 outwardly relative to the closed container and/or simultaneously pressing locking tab 738 inwardly back through aperture 730 to release top panel 732.

The containers of the embodiments of FIGS. 2–8, as well as the containers described below in FIGS. 9–18, may be fabricated from paper, paperboard, cardboard or corrugated paperboard. Preferably, corrugated paperboard will be used. Additionally, the containers may also have a layer of unlined corrugated medium disposed on either or both of the inner or outer surfaces thereof. Further, the inner and/or outer container surfaces may be coated with a waterproof or leakproof substance, or a plastic sheet to resist water or other liquids.

Figure 9:
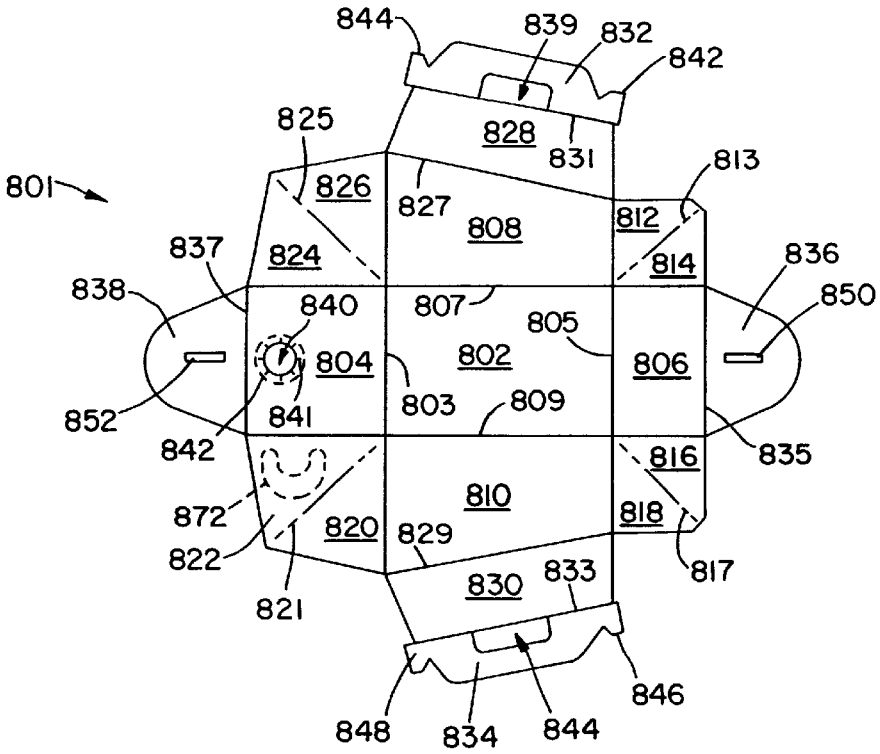
FIG. 9 is a plan view of a blank for forming a self-erecting container apparatus according to another embodiment of the present invention.

Self-erecting container 800 is shown in FIGS. 9–13 as comprising blank 801, nozzle 854 and fluid article holding bag 866. Blank 801 for self-erecting container is shown in FIG. 9 as comprising bottom panel 802, end panels 804 and 806, side panels 808 and 810, paired corner panels 812, 814, 816, 818, 820, 822, 824, and 826, top panels 828 and 830, handle panels 832 and 834, and handle support panels 836 and 838. End panels 804 and 806 foldably emanate from the end edges of bottom panel 802, while side panels 808 and 810 likewise foldably emanate from the side edges of bottom panel 802. Although it is contemplated that side panels 808 and 810 are substantially square or rectangular, thus resulting in a substantially square or rectangular self-erecting container, side panels 808 and 810 are preferably substantially trapezoidal in shape, so, as is discussed in more detail below, the top of the fully articulated self-erecting container is substantially angled or ramped relative to the bottom of the container. Moreover, end panels 804 and 806 preferably differ in size to accommodate this angled- or ramped-top trapezoidal structure.

Figure 10:
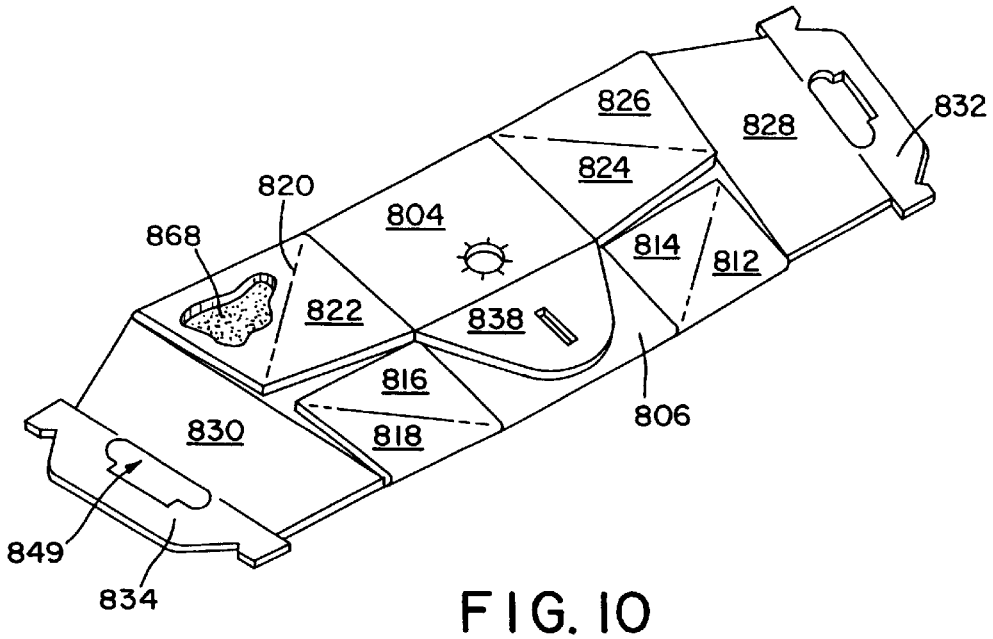
FIG. 10 is a perspective view of a blank for forming a self-erecting container with corner panels affixed to side panels for shipment and storage.
Figure 12:
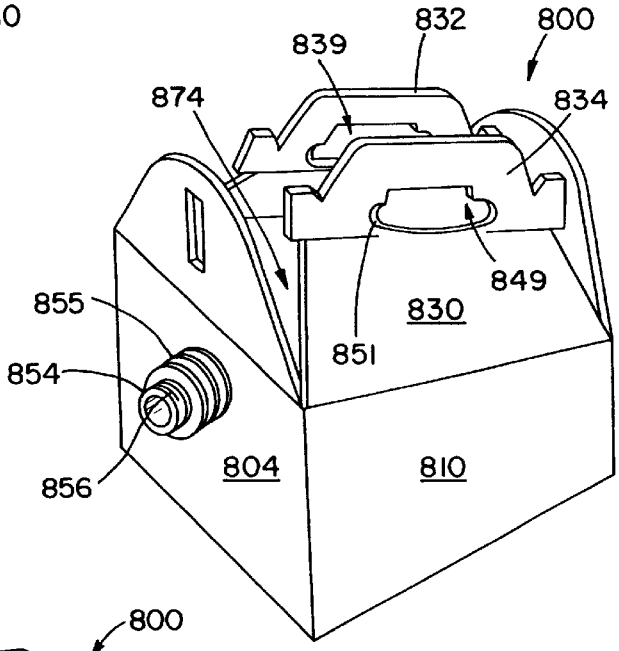
FIG. 12 is a perspective view of a self-erecting container with the container pocket in an erected orientation, but with the top panels, handle panels, and handle support panels unarticulated.

End panel 804, shown as the larger of the two end panels, further includes an aperture 840 capable of accepting nozzle 854, as is shown in FIGS. 9 and 12. Inasmuch as aperture 840 must accept nozzle 854, yet retain the nozzle in a secured position, end panel 804 further comprises a weakened region 841 proximate aperture 840. Weakened region 841 is preferably created by slits 842 in end panel 804 extending from aperture 840 into the end panel in a radial direction. Such a weakened region preferably surrounds substantially all of aperture 840 so as to allow the weakened region to be temporarily deformed upon insertion of nozzle 854, and then regain its original structure to retain nozzle 854 in a secure position. As is shown in FIGS. 9, 10 and 12, and as is explained in more detail below, aperture 840 is preferably positioned proximate the top edge region of end panel 804, to allow the maximum amount of fluid articles or beverage to be placed in liquid holding bag 866 inside the articulated container, without spilling over. Moreover, although aperture 840 is shown in end panel 804, it may likewise be positioned in any of the end, side panels or bottom panel. Likewise, as is described in more detail below, although only one aperture is shown, it is contemplated that more than one aperture and more than one nozzle may be used in conjunction with the present invention.

Lines of weakness 803 and 805 are disposed between the bottom panel and the end panels, and lines of weakness 807 and 809 are disposed between the bottom panel and the side panels—to facilitate articulation of blank 801. While lines of weakness 803, 805, 807, and 809 preferably comprise slotless fold lines, the lines of weakness may also include one or more slots, perforations or scores to facilitate folding of the end panels and side panels with respect to the bottom panel.

Paired corner panels 812 and 814, joined by line of weakness 813, foldably emanate from side panel 808 and end panel 806, respectively. Likewise, paired corner panels 816 and 818, joined by line of weakness 817, foldably emanate from end panel 806 and side panel 810, respectively; paired corner panels 820 and 822, joined by line of weakness 821, foldably emanate from side panel 810 and end panel 804, respectively; and paired corner panels 824 and 826, joined by line of weakness 825, foldably emanate from end panel 804 and side panel 808, respectively. Although lines of weakness 813, 817, 821, and 825 are preferably perforated or scored to facilitate articulation of blank 801 as described below, they may also be slotless fold lines for waterproof, leakproof, or other similar applications. Likewise, although the foldable emanation of the paired corner panels from the end and side panels preferably occurs on a slotted, perforated or scored fold line to facilitate articulation of blank 801, it is contemplated that those fold lines may also be slotless for leakproof applications.

Top panels 828 and 830 foldably emanate from the top edge regions 827 and 829 of side panels 808 and 810, respectively. Although shown in FIG. 9 as trapezoidal in shape, it is likewise contemplated that top panels 828 and 830 may take any number of configurations, such as substantially triangular, substantially quadrilateral, etc.

Handle panels 832 and 834, in turn, foldably emanate from top edge regions 831 and 833 of top panels 828 and 830, respectively. Handle panel 832 preferably comprises opposing side regions, a top edge region, and handle opening 839 with an inner edge region surrounding at least a portion of the handle opening. Handle panel 834 preferably comprises opposing side regions and a top edge region, but also preferably includes a handle panel securing element, such as locking tab 849 (FIG. 12). Locking tab 849 is attached at its top edge region to handle panel 834 and defines handle opening 851, which substantially corresponds in size and shape to handle opening 839. As will be discussed below, locking tab 849 secures handle panels 832 and 834 in a juxtaposed handle locking orientation.

Figure 16:
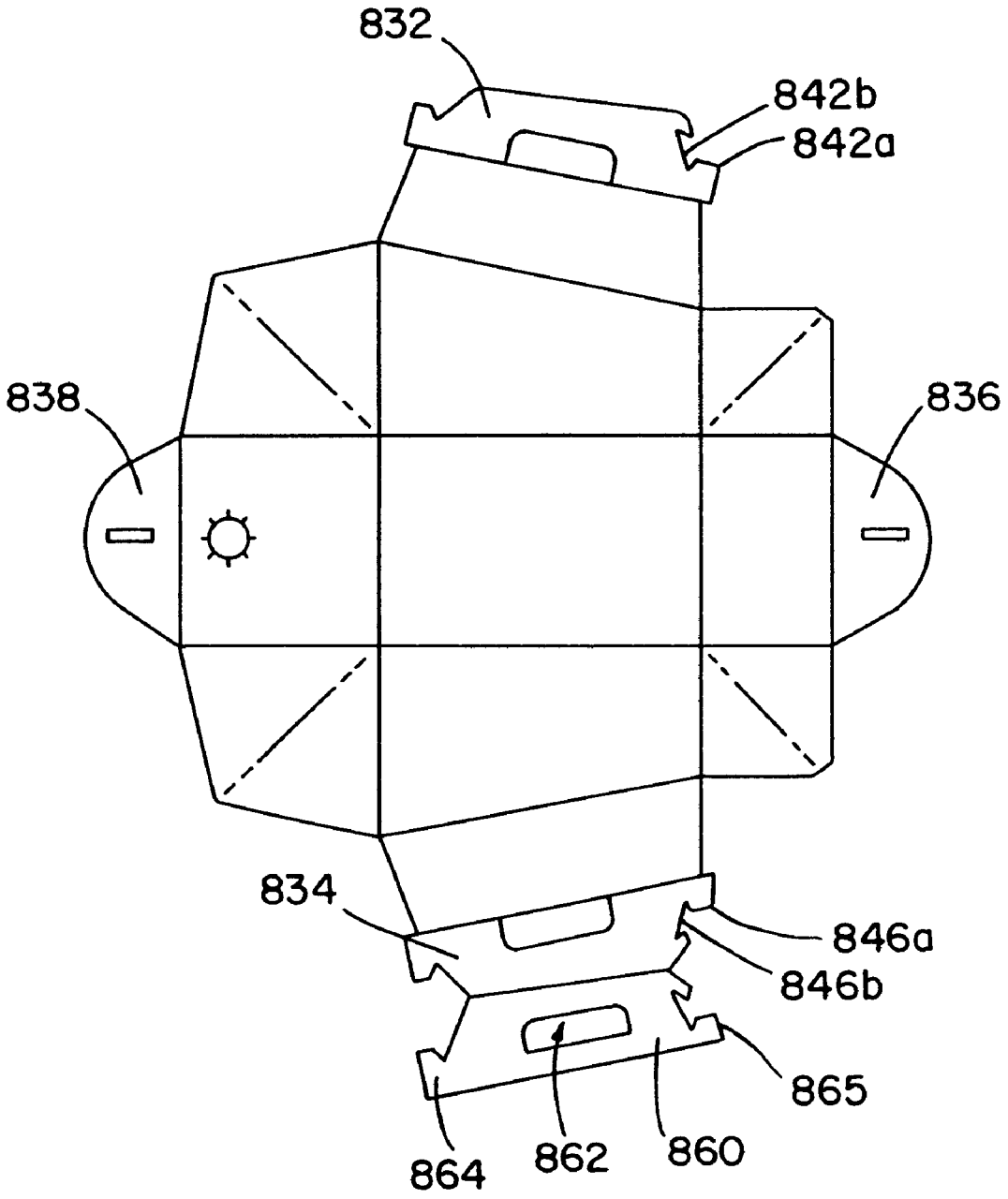
FIG. 16 is a plan view of a blank for forming a self-erecting container apparatus according to still another embodiment of the present invention.

As is shown in FIG. 16, the handle panel securing element may also comprise inverted handle stabilizing panel 860 emanating from the top edge of a handle panel, for instance handle panel 834. Inverted handle stabilizing panel 860 preferably includes handle opening 862, which substantially corresponds to the size and dimensions of handle panel openings 839 and 851, and projecting locking members 864 and 865, which cooperate with handle support panels 836 and 838 as described below. With this handle panel securing element, inverted stabilizing panel 860 and hand panel 834 preferably sandwich hand panel 832 when the container is articulated—for increased handle strength and container integrity. Moreover, it is likewise contemplated that inverted handle stabilizing panel 860 may also include a locking tab, similar to locking tab 849 in handle panel 832, to facilitate securing of the handle panels.

Handle panels 832 and 834 preferably further comprise an additional handle panel securing element, namely projecting locking members 842, 844, 846, and 848 for use in association with handle support panels 836 and 838. Projecting locking members 842 and 844 are associated with the side regions of handle panel 832, while projecting locking members 846 and 848 are associated with the side regions of handle panel 834. Moreover, as is shown in FIG. 16, the projecting locking members may take the form of projecting locking members 842*a* and 846*a*, with accepting regions 842*b* and 846*b*. As will become evident below in discussions relative to juxtaposing the handle panels and associated projecting locking members, this alternative construction enables reinforcement of the connection between projecting locking members 842*a* and 846*a* and handle support panel 836 as the accepting regions releasably lock the top portion of the handle support panel into place. Of course, such a projecting locking member alternative construction is likewise contemplated for projecting locking members 844 and 848 as well.

Handle support panels 836 and 838 foldably emanate from side edge regions 835 and 837 of end panels 806 and 804, respectively, and include slots 850 and 852. Slots 850 and 852 are configured so as to securably and releasably accept projecting locking members 842 and 846, 844 and 848, respectively, upon articulation and juxtaposition of handle panels 832 and 834. Although shown as taking a rounded shape for aesthetic purposes, handle support panels may take any desirable shape.

Bag 866 has at least one opening and is attached to nozzle 854. Bag 866 is preferably constructed to hold any number of fluid articles, including beverages, drink mixes, fluids and other such substances—both hot and cold. An example of such a bag is a metallized three-layer bag constructed from "Hybar45" with a laminated barrier film. Such a bag may be obtained from Scholle Corporation of Northlake, Ill., and is suitable for hot fill and aseptic applications. Additionally, such a bag possesses features of excellent toughness and oxygen protection. Of course, other fluid-holding bags as would be known to those with ordinary skill in the art with the present disclosure before them are likewise contemplated.

Nozzle 854 comprises a first end, a second end and detent 855. Nozzle 854 is preferably tubular in shape, and is attached to bag 866 at first end, preferably forming a fluid tight seal to minimize and even eliminate leakage of fluid articles. Detent 855 is positioned between the first and second ends, and preferably comprises a ring or series of rings having a diameter larger than that of the remainder of nozzle 854. As will be described below, detent 855 not only stabilizes nozzle 854 in container aperture 840, but also prevents the nozzle from being forced back into the container during filling of the bag. Indeed, it is preferred that detent comprises at least two concentric rings, spaced apart so as to sandwich the container wall surrounding aperture 840. Such a construction precludes slippage of the nozzle in either direction, in either a filling or dispensing operation. However, it is likewise contemplated that detent 855 may comprise any protrusion on the outer surface of the nozzle that stabilizes the nozzle.

Moreover, the second end of nozzle 854 preferably comprises a set of mating threads 856, capable of accepting a cap 870, which preferably has a complementary set of mating threads. Such a threaded seal is preferably substantially fluid tight, thus preventing the inadvertent leakage of fluid articles from the container during transportation, use or storage thereof. Although threads are preferred, any substantially fluid tight seal is likewise contemplated. Furthermore, nozzle 854 may be equipped with a fluid flow regulator to control the flow of fluid articles out of the bag and container and through the nozzle. Such a regulator is particularly suited for an aperture and nozzle placement toward the bottom of the container. However, such a regulator may also take the form of a simple stop, which may be removed for filling and/or dispensing fluid articles from bag 866.

Figure 13:
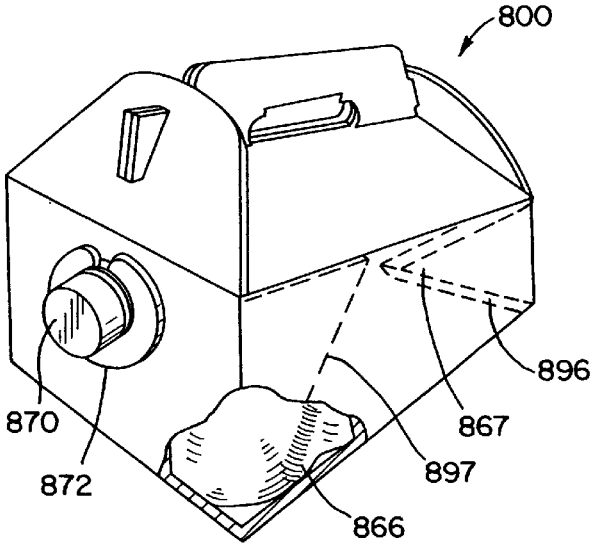
FIG. 13 is a perspective view of a fully articulated self-erecting container according to the present invention.

Additionally, and as is shown in FIG. 13, self-erecting container 800 may further comprise nozzle guard 872, capable of insertion between nozzle detent 855 and the corresponding container panel, such as end panel 804, surrounding aperture 840. Nozzle guard 872 includes both an outer peripheral shape and an inner peripheral shape. While the nozzle guard may take any aesthetically desirable outer peripheral shape, at least a portion of the inner peripheral shape has a configuration substantially corresponding to at least a portion of the shape of nozzle 854. Nozzle guard 872 acts in combination with detent 855 to stabilize nozzle in aperture 840, and to preclude movement of the nozzle back into the interior region of the container during filling of the bag. Moreover, nozzle guard 872 is preferably cut from one of the paired corner panels, shown in FIG. 9 as cut from paired corner panel 822. With this construction, the collar panel may be shipped integral to blank 801 and later easily removed for use, so as to both eliminate additional shipping materials and minimize the likelihood of losing the nozzle guard between manufacture and use. Of course, although nozzle guard 872 is preferably constructed from paperboard material, it is likewise contemplated that the nozzle guard may be constructed from any suitable material, for example plastic.

To place blank 801 into a self-erecting and substantially collapsed orientation, as shown in FIG. 10, end panels 804 and 806 are preferably folded about fold lines 803 and 805 to overlay bottom panel 802. In this position, paired corner panels 812 and 814 and paired corner panels 824 and 826 overlay side panel 808, while paired corner panels 816 and 818 and paired corner panels 820 and 822 overlay side panel 810. Adhesive 868 is applied between corner panels 812 and 826 and side panel 808, and also between corner panels 818 and 820 and side panel 810, to secure those corner panels to the respective side panels. While the adhesive is preferably applied to a substantial portion of the corner panels, so as to provide the greatest secured adhesion between the corner panels and side panels, the adhesive may also be applied to only a portion of the corner panels, such as the central portion, to achieve the desired adhesive effect. Moreover, although the corner panels are described and shown as overlaying side panels 808 and 810, it is likewise contemplated that the side panels may be folded about lines 807 and 809 so that the corner panels overlay end panels 804 and 806. In this arrangement, adhesive would be applied between corner panels 814, 816, 822 and 824 and the respective abutting end panels.

Inasmuch as handle support panels 836 and 838 overlay bottom panel 802, one handle support panel, for instance handle support panel 836, may be tucked under the opposing end panel, for instance end panel 804, for shipment of pre-articulated blank 801. Indeed, it is preferred that handle support panel 836, emanating from the smaller end panel 806, is tucked under larger end panel 804. In this self-erecting orientation, the pre-articulated blank remains substantially flat to facilitate stacking, storage and shipment.

In this self-erecting and substantially collapsed orientation, end panels 804 and 806; handle support panels 836 and 838; unadhered corner panels 814, 816, 822 and 824; bottom panel 802; and side panels 808 and 810 define a container pocket 874. Inasmuch as the blank is in a substantially flat and collapsed orientation, the container pocket is likewise in a substantially collapsed orientation. As is described below, bag 866 and nozzle 854 may be inserted into the container pocket at this point.

Figure 11:
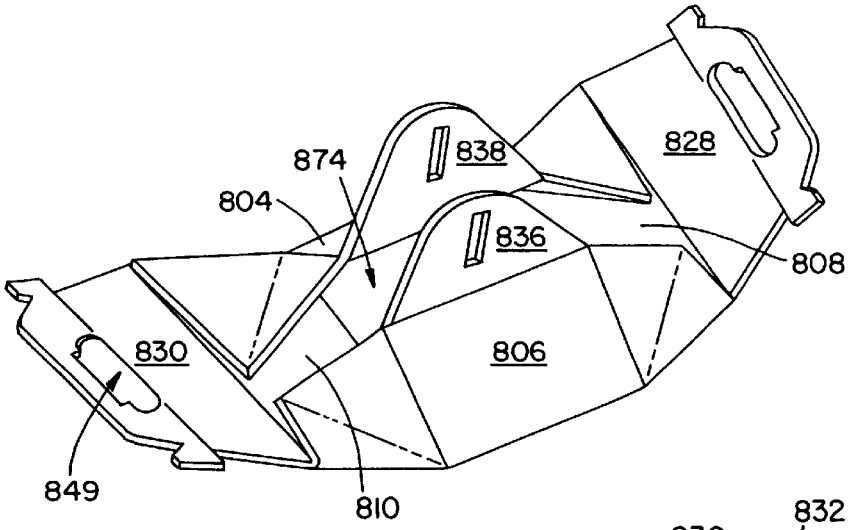
FIG. 11 is a perspective view of a self-erecting container during articulation thereof.

As is shown in FIGS. 11 and 12, to fully articulate blank 801 from the self-erecting and substantially collapsed orientation, side panels 808 and 810 are raised to positions substantially perpendicular to bottom panel 802. By raising the side panels, corner panels 812, 826, 818, and 820, which are affixed to side panels 808 and 810, also rise to a position substantially perpendicular to the base panel and push against corner panels 814, 824, 816, and 822 along the respective lines of weakness separating the paired corner panels. Comer panels 814, 824, 816, and 822, in turn, pull end panels 804 and 806 upwardly into a position also substantially perpendicular to bottom panel 802. Additionally, corner panels 812, 826, 818, and 820 preferably become substantially juxtaposed to their mated corner panels 814, 824, 816, and 822, respectively, thus forming containment ring 867. As discussed below, containment ring 867 secures the filled bag into the container pocket and restricts expansion of the bag beyond the container pocket boundaries.

With the side, end, and corner panels all positioned substantially perpendicular to bottom panel 802 in a substantially erected orientation, shown in FIG. 12, container pocket 874 is in a substantially upright and expanded orientation.

At this point and if not already done, bag 866 is placed into container pocket 874 and nozzle 854 is positioned in aperture 840. Inasmuch as at least a portion of nozzle detent 855 preferably has a size larger than that of aperture 840, weakened region 841 allows the nozzle and detent to be forced through the aperture, while the aperture returns to its original form after positioning of the nozzle. Preferably, a portion of nozzle detent 855 is both outside and inside the container apparatus, thus sandwiching the portion of end panel 804 surrounding aperture 840. Nozzle guard 872 may also be positioned between detent 855 and end panel 804 at this time, so as to further stabilize nozzle 854 in aperture 840 and to provide additional support during filling of the bag.

Of course, if bag 866 and nozzle 854 are positioned in container pocket 874 before expansion of the container pocket, bag 866 is positioned on top of bottom panel 802 before erection. Indeed, when this step is performed before blank and container articulation, the collapsed container pocket is formed around the bag, thus allowing simultaneous expansion and erection of the container pocket and the bag. This articulation sequence is especially useful when attempting to avoid container assembly, and more particularly, when attempting to arrange the bag and nozzle before the point of purchase.

Top panels 828 and 830 are then positioned over substantially expanded container pocket 874 and bag 866 therein, thus substantially enclosing same. In this position, handle panels 832 and 834 abut in a substantially juxtaposed orientation, where they may be secured by any of the above described handle panel securing elements, or combinations thereof. Preferably, locking tab 849 is pressed through handle opening 839 in handle panel 832 to initially secure the handle panels in a juxtaposed relationship. Next, handle support panels 836 and 838 are positioned at least partially over the handle panels, where juxtaposed projecting locking members 842 and 846 pass through handle support panel slot 850, and juxtaposed projecting locking members 844 and 848 pass through handle support panel slot 852. Each pair of juxtaposed projecting locking members is configured, for example with a notch (FIG. 9) or an accepting region (FIG. 16), so as to releasably retain handle support panels 836 and 838. In this orientation, handle support panels not only assist in securing handle panels 832 and 834 in a substantially juxtaposed orientation, but also reinforce the handle feature of self-erecting container 800. Indeed, the handle support panels improve distribution of the stress placed on the handle panels and top panels when transporting or using the container—especially when the bag is full of a liquid beverage.

While self-erecting container 800 may be filled while resting on bottom panel 802, it is preferably oriented such that end panel 806 rests on a surface, with end panel 804, aperture 840, and nozzle 854 facing upward. Fluid articles may then fill the bag through the nozzle in an appropriate amount. Detent 855 and nozzle guard 872 keep the nozzle from reentering or caving into the inner region of the beverage container during the filling operation. The bag is preferably filled to a point where the fluid level is below the aperture when the container is oriented with bottom panel 802 resting on the surface. Cap 870 may then be placed on nozzle 854 to prevent leakage of fluid articles from the container, for transportation and storage of the same.

When rested again on bottom panel 802 in the carrying and dispensing orientation, containment ring 867 secures the at least partially filled bag 866 in container pocket 874. In particular, containment ring 867 protrudes from the side panels from which the paired corner panels abut, thus locking the bag into place during transportation and dispensing of the fluid articles. Moreover, the containment ring also contributes to a container pocket expansion boundary defined by the end panels, side panels and paired corner panels. The substantially continuous expansion boundary minimizes expansion of the fluid filled bag beyond the container pocket and through any container cracks, slits, apertures or seams—to preclude herniation of the bag. The creation of the container expansion boundary is particularly useful when the fluid articles constitutes a hot beverage, which makes the bag increasingly malleable and capable of expanding into every nook or crack in the container pocket. At the same time, exposed ridges 896 and 897 of the paired corner panels, on each side of the container pocket (FIG. 13), lock behind portions of the liquid article-filled bag to preclude against bag "shifting" during transportation and dispensing.

Upon complete articulation, and as is shown in FIG. 13, container 800 preferably has a substantially trapezoidal shape with an angled or ramped top. Such a shape not only facilitates pouring of fluid articles from the container, but also reduces the amount of blank material required to form self-erecting container 800. In particular, any liquid which rises above the level of the aperture and nozzle will spill after the container is oriented to its carrying and dispensing position. Accordingly, there is a set amount of liquid that may be carried by any box of given dimensions. Inasmuch as the aperture and nozzle are preferably positioned in the upper portion of end panel 804, this level remains the same even when the container is a perfect square or rectangle—which requires a larger blank. Thus, less blank material is used to achieve the same effective liquid carrying capacity.

Figure 14:
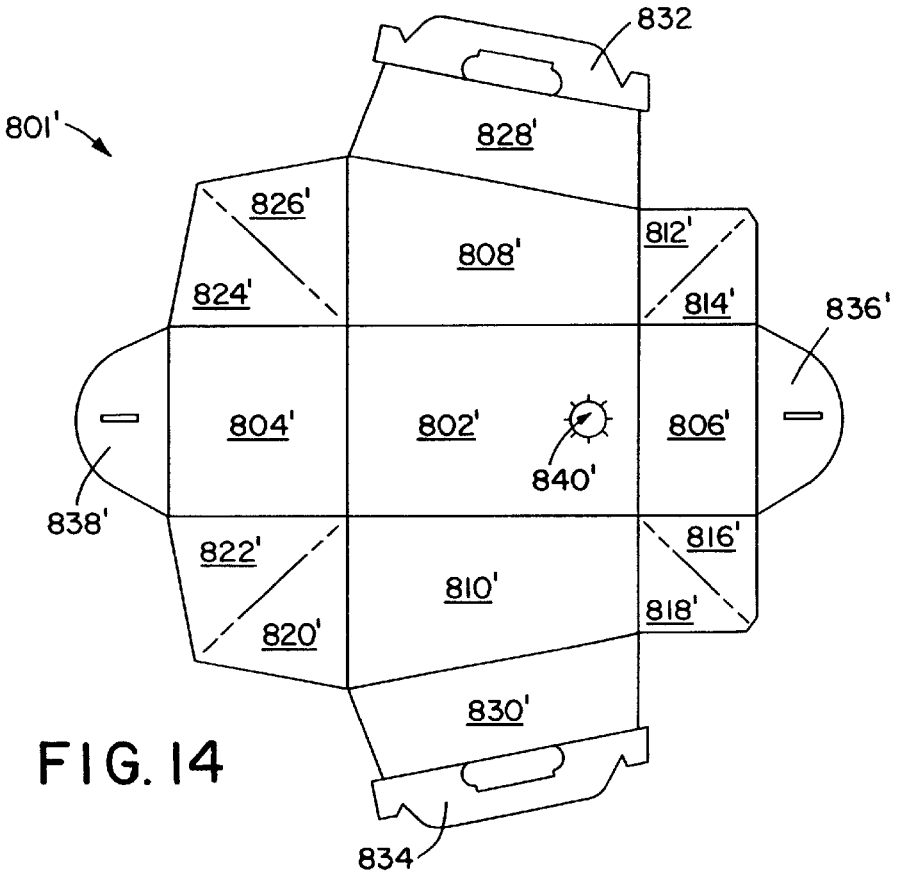
FIG. 14 is a plan view of a blank for forming a self-erecting container apparatus according to yet another embodiment of the present invention.
Figure 15:
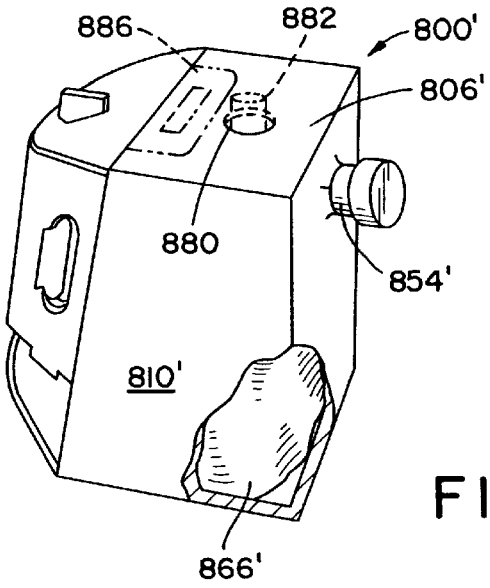
FIG. 15 is a perspective view of a self-erecting container formed from the blank shown in FIG. 14 according to the present invention.

In another embodiment, shown in FIGS. 14 and 15, aperture 840' is placed in bottom panel 802' of blank 801'. While placement of the aperture in the bottom panel does not substantially change blank articulation from that described above, articulated container 800' has a different orientation than that of container 800. Instead of resting on the bottom panel in the primary carrying and dispensing position, container 800' rests on end panel 804'. Such an orientation allows the container to hold a greater volume of fluid articles, while still maintaining the trapezoidal shape for ease in dispensing the fluid articles. Likewise, bag 866' and nozzle 854' may still be placed in the container pocket in either a substantially collapsed pocket orientation, or in a substantially upright and expanded pocket orientation.

Moreover, as is shown in FIG. 15, it is contemplated that container 800' further comprises second aperture 880 and fluid conduit 882. Second aperture 880 is preferably positioned in end panel 806', and configured to accept fluid conduit 882 therethrough. One end of fluid conduit 882 is preferably in fluid communication with the inside of bag 866', while the other end is equipped to receive a threaded cap or other substantially fluid tight cap. As such, fluid conduit 882 may comprise a nozzle, as described above, or any conventional device as would be contemplated by one of ordinary skill in the art with the present disclosure before them. The second aperture and fluid conduit allow the bag to be filled with fluid articles from the convenient top end panel position, while the container remains in a carrying and dispensing orientation. This allows container 800' to be filled through one aperture, and fluid articles to be dispensed from another. Moreover, it is also contemplated that a fluid conduit guard, similar to nozzle guard 872 described above in relation to nozzle 854, may be used to stabilize fluid conduit 882 in aperture 880 and to prevent the fluid conduit from being forced into the container during filling.

Self-erecting container 800' may further include support handle 886. While support handle 886 is shown as attached to end panel 806', it is likewise contemplated that the support handle may be of other configurations, such as a strap attached to the container at the top of side panels 808' and 810'—to span the top of the container. Support handle 886 provides container 800' with an additional carrying mechanism aside from the juxtaposed handle panels.

Figure 17:
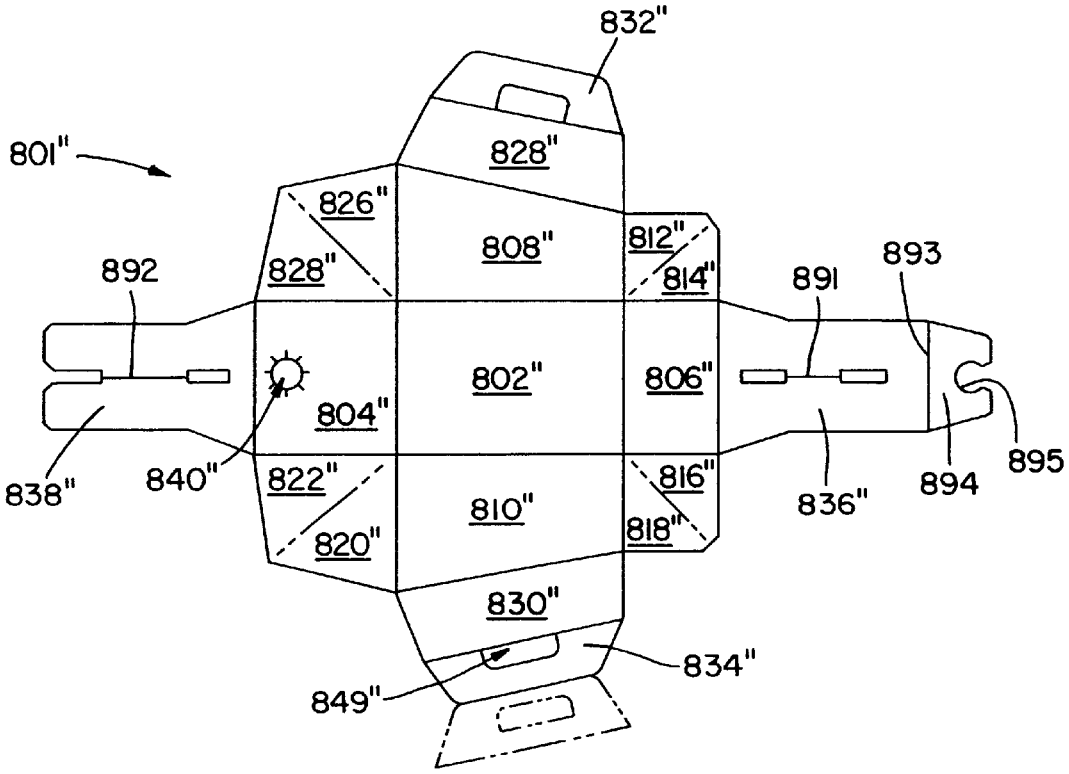
FIG. 17 is a plan view of a blank for forming a self-erecting container apparatus according to another embodiment of the present invention.
Figure 18:
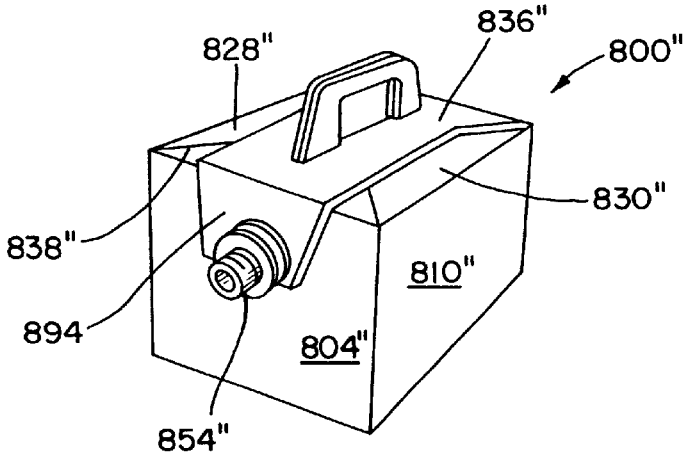
FIG. 18 is a perspective view of a self-erecting container formed from the blank shown in FIG. 17 according to the present invention.

In yet another embodiment, shown in FIGS. 17 and 18 as blank 801" and self-erecting container 800", handle panels 832 and 834 are replaced by differently configured handle panels 832" and 834", and handle support panels 836 and 838 are replaced by handle locking panels 836" and 838" also having a different configuration. In particular, handle locking panels 836" and 838" each include slots 891 and 892, respectively, for receiving handle panels 832" and 834". Moreover, handle locking panel 836" further includes a collar panel 894 foldably attached thereto.

Collar panel 894 includes an inner peripheral region 895 having a shape at least partially corresponding to at least a portion of nozzle 854". Collar panel 894 may be inserted between nozzle 854" and end panel 804". Indeed, collar panel 894 functions much the same as nozzle guard 872 to increase the stability of nozzle 854" in end panel 804" and to prevent the nozzle from being forced through the aperture and into the inner region of the container during filling thereof.

Self-erecting container 800" is articulated in much the same way as container 800, described above, except for articulation of handle panels 832" and 834" and handle locking panels 836" and 838". While handle panels 832" and 834" are still juxtaposed after erection of the container and creation of a substantially expanded container pocket orientation, the handle locking panels 836" and 838" are placed over the handle panels and top panels 828" and 830"—instead of locking the handle panels with handle support panels and the projecting locking members. Specifically, after handle panels are juxtaposed and initially secured with locking tab 849", handle locking panel 838" is folded down over handle panels 832" and 834" such that the handle panels pass through slot 892. In this position, handle locking panel 838" preferably abuts at least a portion of top panels 828" and 830", while portions of slot 892 surround the base of handle panels 832" and 834". Because a portion of slot 892 is preferably a cut line extending between the two larger openings suited to surround the base of handle panels 832" and 834", handle locking panel 838" cannot be easily dislodged from its position surrounding the base of the articulated handle panels.

Next, handle locking panel 836" is likewise folded down over handle panels 832" and 834" such that the handle panels pass through slot 891—until handle locking panel 836" substantially abuts articulated handle locking panel 838". Like slot 892, slot 891 also has portions which surround the base of handle panels 832" and 834", those portions preferably separated by a cut line. As described immediately above, this slot configuration secures handle locking panel 836" over the handle panels such that it cannot be easily dislodged.

After positioning of the handle locking panels, collar panel 894 is then folded about fold line 893 and positioned such that inner peripheral region 895 surrounds at least a portion of nozzle 854". As described above in reference to nozzle guard 872, collar panel 894 is preferably positioned between a detent on nozzle 854" and end panel 804" to stabilize nozzle in aperture 840". Moreover, collar panel 894 also secures handle locking panel 836" in place.

Handle locking panels 836" and 838" not only secure handle panels 832" and 834" in a juxtaposed position, but also add integrity and strength to self-erecting container apparatus 800". In particular, the stress from carrying container 800" is exerted initially on top panels 828" and 830", which are foldably attached to side panels 808" and 810". The abutting relationship of handle locking panels 838" and 836" and the top panels, however, spreads the stress over the handle locking panels and their foldable connection to end panels 804" and 806". Accordingly, the stress is more uniformly distributed over the entire container.

Any of the above described self-erecting container embodiments are not only quickly and easily articulated, but also are easily broken down to a substantially flat pre-erection configuration to facilitate disposal. Moreover, because the self-erecting container blank is preferably constructed from a substantially paper material, it may be recycled in an environmentally friendly manner.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A self-erecting container apparatus for rapid deployment into articulation, and for the facilitated containment and dispensing of fluid articles, said self-erecting beverage container apparatus comprising:

a bottom panel having two opposed end edges and two opposed side edges;

two end panels, each of which end panels emanate from a respective end edge of the bottom panel, each of said end panels having two opposed side edge regions and a top edge region;

two side panels, each of which side panels emanate from a respective side edge of the bottom panel, each of said side panels having two opposed side edge regions and a top edge region;

at least one of said bottom panel, said two end panels, and two side panels having at least one aperture oriented therethrough;

a plurality of lines of weakness disposed between the bottom panel and the end panels and between the bottom panel and the side panels, respectively;

at least one paired corner panel, one panel of each corner panel pair emanating from the side edge region of at least one of said end panels, and the other panel of each corner panel pair emanating from the side edge region of at least one of said side panels substantially adjacent to said at least one end panel;

a line of weakness disposed between the panels of said at least one pair of corner panels;

said at least one paired corner panel being folded into a position overlaying and substantially juxtaposed and affixed to at least one of said side panels and said end panels, to create, at least in part, at least one container pocket having a substantially collapsed orientation, such that raising at least one of the end and side panels toward positions substantially perpendicular to the bottom panel causes one of said adjacent side and end panels to be drawn by the affixed corner panel pairs to prompt said container pocket toward a substantially upright orientation, thus operably expanding the size of said container pocket;

a bag operably positioned in said container pocket in at least one of said substantially collapsed and said substantially upright orientations, said bag being capable of containing fluid articles;

a nozzle, having at least two ends, operably associated with said bag so as to facilitate at least one of filling and dispensing fluid articles into and from said bag, and, in turn, into and from said container, said nozzle being positionable within and through said aperture.

2. The self-erecting container apparatus according to claim 1 wherein said nozzle includes at least one detent element for operably stabilizing and releasably retaining said nozzle within said at least one aperture.

3. The self-erecting container apparatus according to claim 2 further comprising a nozzle guard capable of insertion between said at least one detent element and the corresponding container apparatus panel, for stabilization of said nozzle within said at least one aperture.

4. The self-erecting container apparatus according to claim 1 further comprising at least one handle operably associated with said container apparatus to facilitate transportation and use thereof.

5. The self-erecting container apparatus according to claim 1 further comprising at least one top panel operably emanating from the top edge region of at least one of the side panels and end panels, said at least one top panel having a top edge region, said top panel operably configured for overlaying at least a portion of the container pocket when in said substantially expanded orientation, toward a substantially container closing position.

6. The self-erecting container apparatus according to claim 5 further comprising:

at least one handle panel operably emanating from the top edge region of said at least one top panel for facilitating positioning of the at least one top panel in a container closing position, said at least one handle panel having opposing side regions, a top edge region, at least one handle opening, and an inner edge region surrounding at least a portion of the at least one handle opening;

a handle panel securing element associated with at least one of said handle panels for operably securing said handle panels in a juxtaposed position, and, in turn, securing said top panels in a container closing orientation.

7. The self-erecting container apparatus according to claim 6 wherein said handle panel securing element comprises a locking tab operably emanating from said inner edge region of said at least one handle panel.

8. The self-erecting container apparatus according to claim 6 wherein said handle panel securing element comprises at least one projecting locking member associated with at least one of said opposing side regions of said at least one handle panel.

9. The self-erecting container apparatus according to claim 8 further comprising:

said at least one top panel operably emanating from the top edge region of at least one of said side panels; and at least one handle support panel emanating from the top edge region of at least one end panel, said handle support panel having a slot configured to accept and releasably retain said at least one projecting locking member, to, in turn, releasably retain and lock said handle panels in a juxtaposed and container closing orientation.

10. The self-erecting container apparatus according to claim 6 wherein said handle panel securing element comprises:

an inverted handle stabilizing panel emanating from the top edge region of at least one of said handle panels, at least a portion of said inverted handle stabilizing panel having a configuration substantially matching the configuration of at least one of said handle panels, so as to facilitate folding of said inverted handle panel over one of said handle panels to releasably retain and lock the handle panels in a juxtaposed and container closing orientation.

11. The self-erecting container apparatus according to claim 6 further comprising:

said at least one top panel operably emanating from the top edge region of at least one of said side panels; and a handle locking panel emanating from the top edge region of at least one of said end panels, said handle locking panel having at least one slot for operably receiving and securing said handle panels when the handle panels are in a substantially juxtaposed orientation.

12. The self-erecting container apparatus according to claim 11 further comprising:

a nozzle guard panel emanating from one of said handle locking panels, at least a portion of said nozzle guard panel having a configuration substantially corresponding to the configuration of said nozzle, said nozzle guard panel configuration facilitating insertion of at least a portion of said nozzle guard panel between said nozzle and said end panel upon articulation of the container apparatus for preventing escape of said nozzle through said opening and into the container apparatus during filling of said bag with fluid articles.

13. The self-erecting container apparatus according to claim 6 further comprising a secondary handle operably associated with said container apparatus to facilitate handling, use and transportation thereof.

14. The self-erecting container apparatus according to claim 1 wherein said bag is positioned in said container pocket when said container pocket is in a substantially collapsed orientation such that upon articulation of said container apparatus, both said container pocket and said bag are simultaneously articulated to an expanded, fluid article receiving orientation.

15. The self-erecting container apparatus according to claim 1 wherein at least two of said bottom panel, said two end panels, and said two side panels have apertures, said apertures in combination facilitating the filling and dispensing of fluid articles into and from said bag.

16. The self-erecting container apparatus according to claim 15, wherein said nozzle is positionable in at least one of said apertures for dispensing fluid articles from said bag, and a fluid conduit is positionable in another of said apertures to facilitate filling of said bag with said fluid articles.

17. The self-erecting container apparatus according to claim 1 further including a weakened region proximate at least a portion of said aperture for allowing insertion and removal of said nozzle.

18. The self-erecting container apparatus according to claim 1 wherein said end panels are of differing dimensions so as to give the container apparatus a substantially trapezoidal shape upon articulation.

19. The self-erecting container apparatus according to claim 1 wherein said aperture is operably positioned in one of said end panels.

20. The self-erecting container apparatus according to claim 1 wherein said aperture is operably positioned in said bottom panel.

21. The self-erecting container apparatus according to claim 1 further comprising a releasable cap for operably covering at least one end of said nozzle during transportation and storage of said container apparatus.

22. The self-erecting container apparatus according to claim 1 wherein said at least one paired corner panel creates a containment ring in said substantially expanded container pocket to restrict expansion of the bag, when at least partially filled with fluid articles, beyond a container pocket boundary defined by said bottom panel, end panels, side panels and at least one paired corner panel, and the attachment points thereof.

23. The self-erecting container apparatus according to claim 1 wherein said at least one paired corner panel secures said bag, when at least partially filled with fluid articles, inside said substantially expanded container pocket during storage, transportation and dispensing of said fluid articles.

24. The self-erecting container apparatus according to claim 1 wherein said container apparatus is fabricated from a material selected from the group consisting of paper, paperboard, cardboard and corrugated paperboard.

25. The self-erecting container apparatus according to claim 1 wherein said container apparatus is coated with one of a waterproof substance, a leakproof substance and a plastic sheet to resist liquids.

* * * * *

UNITED STATES PATENT AND TRADEMARK OFFICE

CERTIFICATE OF CORRECTION

PATENT NO. : 6,253,993 B1
DATED : July 3, 2001
INVENTOR(S) : Lloyd et al.

It is certified that error appears in the above-identified patent and that said Letters Patent is hereby corrected as shown below:

Column 8,
Line 45, between "298a" and "298d", insert a dash [-]

Column 18,
Line 51, delete "Comer", and insert -- Corner --

Signed and Sealed this

Twenty-first Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,253,993 B1
DATED : July 3, 2001
INVENTOR(S) : Lloyd et al.

It is certified that error appears in the above-identified patent and that said Letters Patent is hereby corrected as shown below:

Column 3,
Line 16, after “corner”, insert -- panels --

Column 6,
Lines 43 and 46, before “invention”, insert -- present --
Lines 51, 54, 56, 61 and 65 after “container”, insert -- apparatus --

Column 7,
Line 7, after “container”, insert -- apparatus --
Line 30, delete “ends”, and insert -- end --

Column 8,
Line 27, after “to”, insert -- be --

Column 10,
Lines 15 and 17, delete “emanated”, and insert -- emanate --

Column 11,
Line 10, delete “ends”, and insert -- end --

Column 12,
Line 51, after “them”, insert -- ) --

Column 14,
Line 18, delete “abuftingly”, and insert -- abuttingly --

UNITED STATES PATENT AND TRADEMARK OFFICE

CERTIFICATE OF CORRECTION

PATENT NO. : 6,253,993 B1
DATED : July 3, 2001
INVENTOR(S) : Lloyd et al.

It is certified that error appears in the above-identified patent and that said Letters Patent is hereby corrected as shown below:

Column 16,
Lines 30 and 31, delete "hand", and insert -- handle --

Signed and Sealed this

Nineteenth Day of November, 2002

*Attest:*

*Attesting Officer*

JAMES E. ROGAN
*Director of the United States Patent and Trademark Office*